US006152031A

United States Patent [19]

DeCruz

[11] Patent Number: 6,152,031

[45] Date of Patent: Nov. 28, 2000

[54] STS DAYLOADER SYSTEM

[76] Inventor: Rudolf R. DeCruz, 10101 N. Arabian Trail, Apt. 2022, Casabella Apts., Building #5, Scottsdale, Ariz. 85258

[21] Appl. No.: 09/248,058

[22] Filed: Feb. 10, 1999

[51] Int. Cl.[7] ..... B41M 1/12

[52] U.S. Cl. ..... 101/129; 101/115; 101/126; 101/127.1

[58] Field of Search ..... 101/114, 115, 101/123, 124, 126, 127.1, 129

[56] References Cited

U.S. PATENT DOCUMENTS

| | | | |
|---|---|---|---|
| 4,195,567 | 4/1980 | Mitter | 101/115 |
| 4,223,602 | 9/1980 | Mitter | 101/128.21 |
| 4,911,070 | 3/1990 | Miske et al. | 101/126 |
| 5,107,760 | 4/1992 | Pratt | 101/115 |
| 5,740,729 | 4/1998 | Hikita et al. | 101/126 |

*Primary Examiner*—Ren Yan

*Attorney, Agent, or Firm*—Fitch, Even, Tabin & Flannery

[57] ABSTRACT

A screen printing system has multiple screen cassettes stored in a magazine and a first screen cassette is transferred from the magazine into a printing station. A motorized pallet conveyor conveys a plurality of substrates, each of which is loaded one of a series of pallets of the conveyor, into and from the printing station and about an endless path. After printing the first image or color, the first screen cassette is returned to the magazine and a second preregistered screen cassette is brought to the printing station with a second image or color being printed on each substrate as the pallets carrying the substrates are conveyed into and from the printing station. Preferably, the substrates and pallets are maintained in a horizontal position while they travel laterally, downwardly and upwardly when moving along the endless path. The magazine preferably is motorized with the cassettes being shifted vertically within the magazine to and from a transfer position from which the cassettes are transferred laterally to the printing station. A manual squeegee may be used for the screen printing operation.

38 Claims, 19 Drawing Sheets

STS DAYLOADER SYSTEM

FIELD OF THE INVENTION

This invention relates to a multi-color or image screen printing system that includes a preregistration method and unit for preregistering screens onto cassettes and that includes a screen printing apparatus having a tower or magazine to store cassettes for use at a printing station.

BACKGROUND OF THE INVENTION

Screen printing has a variety of uses in printing art designs or information on various materials such as clothing, garments, posters, signs, and objects made of glass and metal. The most important advantage of screen printing is that it provides a high quality print using equipment that is relatively uncomplicated and inexpensive compared to other printing methods. A typical print screen used for screen printing is composed of a frame made of wood or metal with a fabric or metal mesh print screen mounted tautly in the lower portion of the frame. In screen printing, a positive of the artwork to be printed is positioned onto the screen which has been prepared with a light sensitive emulsion. The screen is then processed or exposed to light, hardening the unprotected areas of the screen such that they are no longer porous. The areas protected by the positive image are not hardened and can be rinsed porous thus creating a negative of the desired artwork on the screen. This negative image is then used to print the image on the desired fabric, garment or other imprint material. Usually, this is accomplished by positioning the screen against the imprint material and using a squeegee to force gelatinous ink through the uncovered areas of the screen. When the screen is removed the desired image is left on the imprint material. One skilled in the art can see that there are other ways of producing the positive image onto screens. To obtain a high quality image in screen printing it is desirable for the screen image to register precisely with a predetermined print area on a platen (and thus on any garment or substrate to be imprinted that is placed on the platen). Registration in such a manner permits the printed image to be placed at exactly the same location on successive substrates. Precise registration is particularly important when a series of prints must be made on the same garment or piece of substrate to provide a multi-colored image. In such a case even minute displacement of one colored image can significantly affect the image quality.

The most common type of existing screen printing press is the manual rotary press. A manual rotary press is composed of a series of platens radiating angularly from a vertical rotating shaft. Mounted above each of these platens is a screen frame holding assembly. The screen with the desired image is mounted into a screen frame holding assembly and then rotated so that it is positioned above the printing platen and lowered into place. The disadvantage of manual rotary presses is the large amount of space that is required for the spoke-like construction of the platens and for the mounting and rotation of the frame holding assemblies. Moreover, many manual rotary presses rely on precision in the rotation and clamping systems to maintain registration; such systems are susceptible to wear and even minimal amounts of looseness in the assembly can cause significant problems in image quality. In addition, the use of such a system involves significant on-press setup time to accurately mount and register all of the required screen frames before a single print can be made.

Many existing screen printing machines require registration of screens to be conducted on the printing press itself.

In one common method of registration the images are roughly centered on the print screens and then the screen frames are inserted into a screen holder. Each screen in its holder is then positioned on the printing press and a sample print is made. Using trial and error, the screen is repeatedly adjusted in the screen holder, clamped down, and reprinted until the image is in registration. Depending on the experience of the operator, the trial and error procedure of registering the images on the printing press can take a long time and requires someone experienced in the art to line up the images by eye. Setting up the images on the press also dictates that the press be non-operative during that time resulting in increased costs from press downtime. Another variant of on-press registration involves taping the positives onto the printing platen area and then aligning the screen, which contains the negative image, to the positive. While this method does not rely on repeated test printing of the images it is still time consuming and requires great care and technique, as even a slight offset in aligning any of the positives in the print area will affect image quality. In an effort to improve the operator's ability to line up the images by eye, some printing machines use micro-registration devices to facilitate adjustment of the screen image by minute fractions of an inch. Such micro-registration devices still require experience to operate and do not result in significant reduction in the time needed to register images as the process relies on trial and error and minuscule adjustment of knobs and clamps. In addition, existing micro-registration devices usually only permit limited range of movement through discrete adjustments along X and Y axes.

Because of the problems associated with on-press registration, methods have been developed that attempt to pre-register the image off-press. One method involves the use of a carry sheet to maintain alignment of the images during creation of the negatives. A carry sheet is a sheet of vellum or cellophane that has a set of pre-punched holes at the top and which is slipped securely underneath the positive for support. Carry sheets suffer from a host of problems. The positive can move on the carry sheet if the tape or other adhesive method used to adhere the positive to the carry sheet, fails. The carry sheet is cumbersome because it must be significantly larger then the positive and the added material makes butt registration more difficult. Finally, carry sheets represent an extra cost and are not very accurate, especially when the operator wants to re-align the positives for reprinting, as the sheets are susceptible to bending, folding and changing shape. Another method of off-press pre-registration involves separately registering the image within the screen frame and then registering the screen frame to the printing platen area. This two step registration process results in less downtime on the printing press. Existing systems involve the attachment of various brackets to the screen frame which are then mated with corresponding connectors on the print head. Such systems are complicated and increase the time required for printing as the brackets must be precisely attached or registration can be affected. In addition, the use of such brackets is impractical for screens of varying sizes and shapes or on warped or damaged screens.

As stated above, multi-color, screen printing is typically done on screen printing presses having platens or pallets indexing substrates on the pallets through an endless path through a number of printing stations along the endless path. Different colors and/or images are printed at the different stations. In rotary, multi-color, screen printing presses of the automated kind, a stepping mechanism steps the pallets from one printing station for one color to and through another printing station for printing another color. Typically, pivoted printing heads at each printing station are heavy and carry motor-driven squeegee carriages with squeegees therein. These machines became quite heavy, large and expensive. In addition, they require considerable set-up time and cannot be quickly changed from one small job to the next small job. Although they are quite fast when properly set up, the set-up and take-down time make them inefficient for small jobs where set-ups and take-downs are frequent.

Another problem for screen printers who have large rotary screen printers is that of printing samples or proofs, in order to sell a job to a customer or to obtain the customer's approval of the multi-color printing on the substrate, such as T-shirt or the like. Often, only a dozen or so samples are printed. The interruption of the production time of a large screen printing apparatus to set and run a dozen samples as well as the time to break down the press and to return the screen printing press to production is a large cost to the screen printer. A screen printer may have to make samples, or proofs, for four or five customers and await their commissioning full production.

Another form of the multiple screen printing press is the oval press wherein pallets carrying the substrates travel in a horizontal plane carrying substrates seriatim through printing stations, each having a large motor-driven squeegee assembly. Like rotary presses, the oval rotary presses have large, pivoted or rectilinearly traveling, printing heads at each printing station. These oval machines are large in size, heavy, relatively expensive, and require considerable set-up and take-down time like the rotary, multi-color screen printing apparatus. They are not very efficient in screen printing small jobs and are not very efficient in printing small order samples, or proofs, for customers.

At the other end of the screen printing spectrum are manual, small screen printing presses often used to print a single color or multi-color jobs having a manually activated squeegee and a manually indexable table supporting one or more pallets for indexing into the printing station. Such machines are small, inexpensive and relatively efficient for small jobs; but they lack the speed of operation of the larger, expensive, fully automated, rotary or oval screen printing presses. Moreover, they may not be precise enough in their printing to be used for samples, or proofs, which are intended to be run on large, expensive machines.

Thus, there is a need for an economical, multi-color, screen printing system that is efficient in forming and preregistering screens in cassettes and that is efficient in storing and using these cassettes for printing samples, or proofs, for a number of customers and small jobs for various customers.

In recent times, screen printers have seen profits fall as they are forced to print multi-color jobs, that are burdened with increased costs from additional setup time, art preparation or screen preparation, at a price that was once reserved for single color designs. The demand for multi-colored prints has caused many small screen printers to end up competing against larger screen printing companies that, by nature of their size and resources, have more and better equipment and who deal in volume. The average buyer has come to expect a two and three color job for the same price of a one-color job. To compete small screen printers have been forced to reduce or eliminate charges for services such as screen preparation, artwork, ink changes and multi-color prints. The subject invention was developed to address the problem of escalating cost and production times in the screen printing industry, allowing multi-color jobs to be more competitive, and to improve upon existing preregistration systems which are complicated, time consuming, inaccurate and labor intensive.

SUMMARY OF THE INVENTION

A screen printing system is provided that results in a faster and more economical preregistration of images and printing screens and a subsequent printing of multiple images, particularly a multiple color image on a substrate, particularly for small jobs including samples or proofs, using printing screens mounted in cassettes. This is achieved with a relatively small and inexpensive screen printing system, as contrasted with large and expensive prior art systems. In the system of this invention, multiple screen cassettes are stored in a magazine, preferably in printing sequence with a first screen cassette at the printing station; and pallets containing substrates are indexed into and through the printing station where a first image from the first cassette is printed on each substrate. After printing the first image or color on the substrates on all of the pallets, the first screen cassette is returned to the magazine, and a second preregistered screen cassette is brought to the printing station; and the process of printing the substrates with a second image or color is repeated as each substrate is again indexed through the printing station for a second time. Preferably, a manual squeegee is employed to print the substrates at the printing station although a motorized squeegee could be employed; and the pallets are indexed by a motor drive.

A large number of pallets are provided in a small space—preferably, for travel beneath the printing station. The pallets are indexed by the operator manually operating a switch to cause the motorized conveyor to index the pallets through one step about an endless path orbiting about a horizontal axis. In the preferred embodiment of the invention, the pallets and substrates thereon are kept in a horizontal position to avoid ink flow, or shifting of the substrate onto the pallet as the pallets travel vertically down, around and up in their travel path. The preferred travel path includes an inspection station preferably located at the same level and preferably on one side of the printing station and a take-off station preferably located at the same level and on the other side of the printing station. In the preferred embodiment of the invention, the pallets travel in a serpentine path beneath the printing station.

In the illustrated embodiment of the invention, the cassettes are stored in a vertical magazine having a motorized shelf conveyor indexed by an operator switch to shift each cassette into a transfer level for movement along a track to and from the printing station. Preferably, the cassettes are provided with wheels, and the operator rolls the cassettes along the track to and from the printing station in the sequential order of the multiple printing. A single screen printing station may be provided but a large number of pallets and substrates are mounted on the motorized pallet conveyor for quick indexing into and from the single printing station for a fast printing cycle for each color. A second print station may be positioned adjacent the first station to double the capacity and to increase job flexibility, if so desired. To assure a setting or curing of the ink, it is preferred to use heat or light at a setting or curing station below the printing station and through which each substrate is indexed. Preferably, the setting or curing station is located beneath the level of the screen printing station to save space. A cooling of the ink and substrate may also be provided by a fan.

In accordance with an important aspect of the invention, a faster and more inexpensive system is achieved by use of a preregistration unit method of the multiple cassettes prior to placing the cassettes into the printing apparatus. The preregistration unit allows preregistration of a print positive for job onto mesh screens. After the screens are created, the screens are accurately registered within a cassette. The preregistration unit also is used for taping and pin holding prior to sending the cassette to the printing apparatus. Thus, the screens may be registered, taped, and pin holed at the preregistration unit so that no further adjustment or registrations of the screens needs to be done at a printing station except for the registration of the overall cassette.

At the preregistration unit, the off contact distance is set and a unique joystick method and device are used for preregistration. This joystick method of micro-registration allows adjustment of the printing screen by minute fractions of inch in a 360° directional movement rather than typical orthogonal X and Y directional movement.

In accordance with the invention, the off contact distance for each screen in each cassette may be preset, preferably set so that the screen will be parallel to substrate and at a set distance from the substrate. Herein, the cassette is formed with an outer frame having off-contact members at all four corners that can be adjusted to set and maintain the specific off-contact distance. The preferred off-contact members are adjustable wheel assemblies that will engage and will roll along the tracks and rest on the printing frame at the printing station of the printing apparatus. The vertical position of the wheels at the preregistration unit is adjusted by turning threaded shafts to change the relative distance between the screen in the cassette and the bottom rolling surfaces of the wheels. The wheels also allow the cassette to be rolled between the magazine cart or tower and the printing station.

The preferred cassette is capable of handling a variety of sizes of printing screen frames. To this end, the cassette is formed with an inner frame having adjustable rails that are shifted to adjusted positions along the outer frame and then locked at the adjusted position for the size of screen printing frames being used. The inner frame is shiftable relative to the outer frame to allow alignment of the printing screen with locating points on the preregistration unit that will also be used to register the other screens for the same job. Hence, all screens on all cassettes for a job will be aligned in a similar manner on the preregistration unit and this assures the registrations of the multiple images from the cassettes being registered at the printing station. Preferably, the printing platen or pallet is also registered by registering pins at the printing station so that all of the multi-color of a multi-color job are properly registered.

By storing several multi-color jobs on registered cassettes in the magazine, an operator may easily switch from one job to the next job merely by changing cassettes without any tearing down or setting up of the press, as is the case of conventional rotary, or oval, automated, multi-color presses. Also, the present invention allows the operator to print a proof run or a sample run for the customer and store the cassettes in the magazine. After receiving the customer's approval, the cassettes can then be used, one at a time, for multi-color printing without having any registration problems or any new press set-up with the printing press of the present invention; or the screens may be removed from the cassettes and used on a large, high speed, printing press for a large production of the approved proof or sample.

The present invention offers advantages and improvements over prior manual screen printing systems because it provides an integrated, compact, efficient and cost effective system for the entire screen printing process from preparation of screens, to registration, to printing, to drying and cooling. The invention improves upon older screen printing processes by greatly reducing the amount of time required to set up and print a job and by providing an integrated system that is efficient and easy to use.

The invention overcomes the disadvantages of the prior art by lowering labor times associated with set-up and the printing process and thus cut costs associated with small volume runs of multi-color jobs. The subject invention incorporates features that reduce the time consuming aspects of producing a print job and adds these savings up to produce a system that not only saves time but labor cost.

The invention reduces the amount of space needed to conduct a multi-color screen printing job from start to finish. The invention has a compact rectangular shape, not the usual circle or oval found in rotary presses and takes up significantly less room than existing presses with comparable production capabilities. Moreover, the invention integrates heating/curing and cooling functions reducing the amount of extra equipment needed for the printing process.

The invention provides a system whereby the time needed for registration of positives and print screens is minimized and does not require downtime of the printing press. The invention also provides an accurate system for registering screens in cassettes that permits the cassettes to be transported and stored without the need for further registration when finally loaded onto the press for printing. The invention creates a system that can store a plurality of print screens so that multiple jobs can be loaded into the system for easy access by the operator while still permitting jobs and individual screens to be easily switched or added.

DETAILED DESCRIPTION OF THE PREFERRED EMBODIMENT

Figure 10:
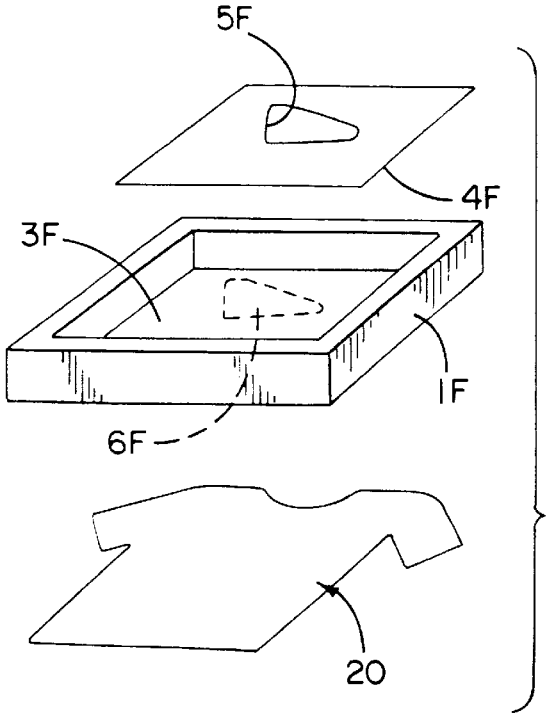
FIG. 10 is a diagrammatic, perspective view of screen with an image thereon for being mounted in a screen printing frame.
Figure 3:
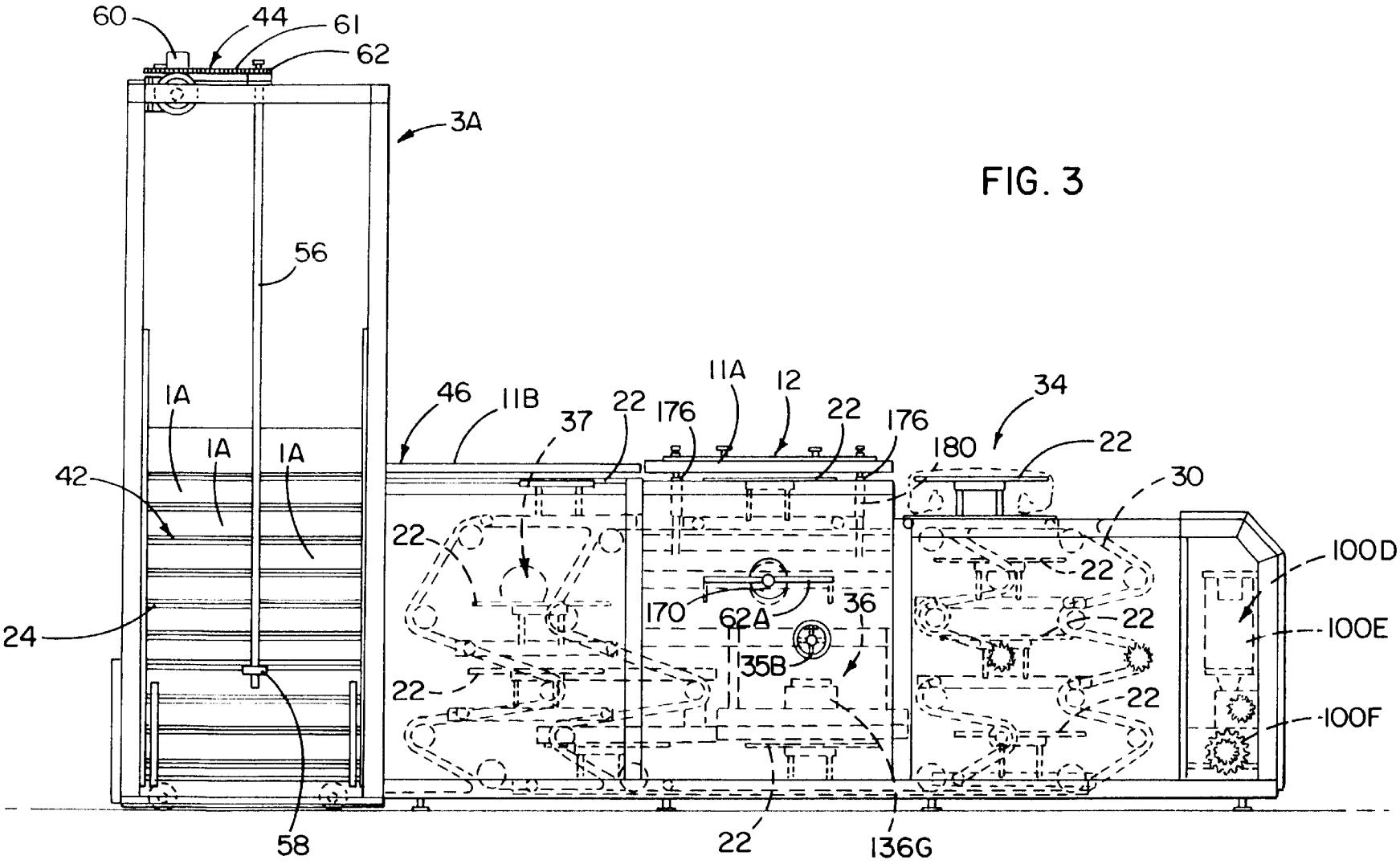
FIG. 3 is a front elevational view of the screen printing apparatus of FIG. 2.

As shown in the drawings for purposes of illustration, there is provided a silk screen printing apparatus 4A (FIG. 1) which includes a printing station 12 on the screen printing apparatus wherein a cassette 1A (FIG. 9), having a printing screen 3F (FIG. 10) with an image 6F thereon, is used to print an image onto a substrate 20 (FIGS. 3 and 10) mounted on a platen or pallet 22 (FIG. 3). A plurality of cassettes usually mounted in serial order in which they will be used to print onto the substrate are mounted in a removable magazine 24 (FIG. 1), and are movable, one at a time, from the magazine to the printing station at which a particular color or image 18 (FIG. 9) is printed with respect to that cassette onto the previously-printed image on the substrate.

In accordance with the present invention, a screen printing method and apparatus 10 provide a faster and more economical printing of multiple images with a relatively small and inexpensive screen printing apparatus. This is achieved by mounted the printing screen 16 in the cassette 1A, with the cassette being stored in the magazine, and shifted to the printing station 12 where indexable pallets are carried by motorized and indexable pallet conveying mechanism 30 into and through the printing station for a printing operation on a substrate on a pallet. In accordance with the illustrated and preferred embodiment of the invention, the pallet conveying mechanism 30 (FIGS. 2 and 3) conveys the pallets 22 along a path located at a lower level and at a vertically different level than the printing station. In the illustrated embodiment of the invention, there are ten (10) indexable platens 22 which are movable about a serpentine path from an upper printing station through a loading and unloading station 34 and downwardly and through a curing or setting station 36 located beneath the printing station to conserve space.

Figure 1:
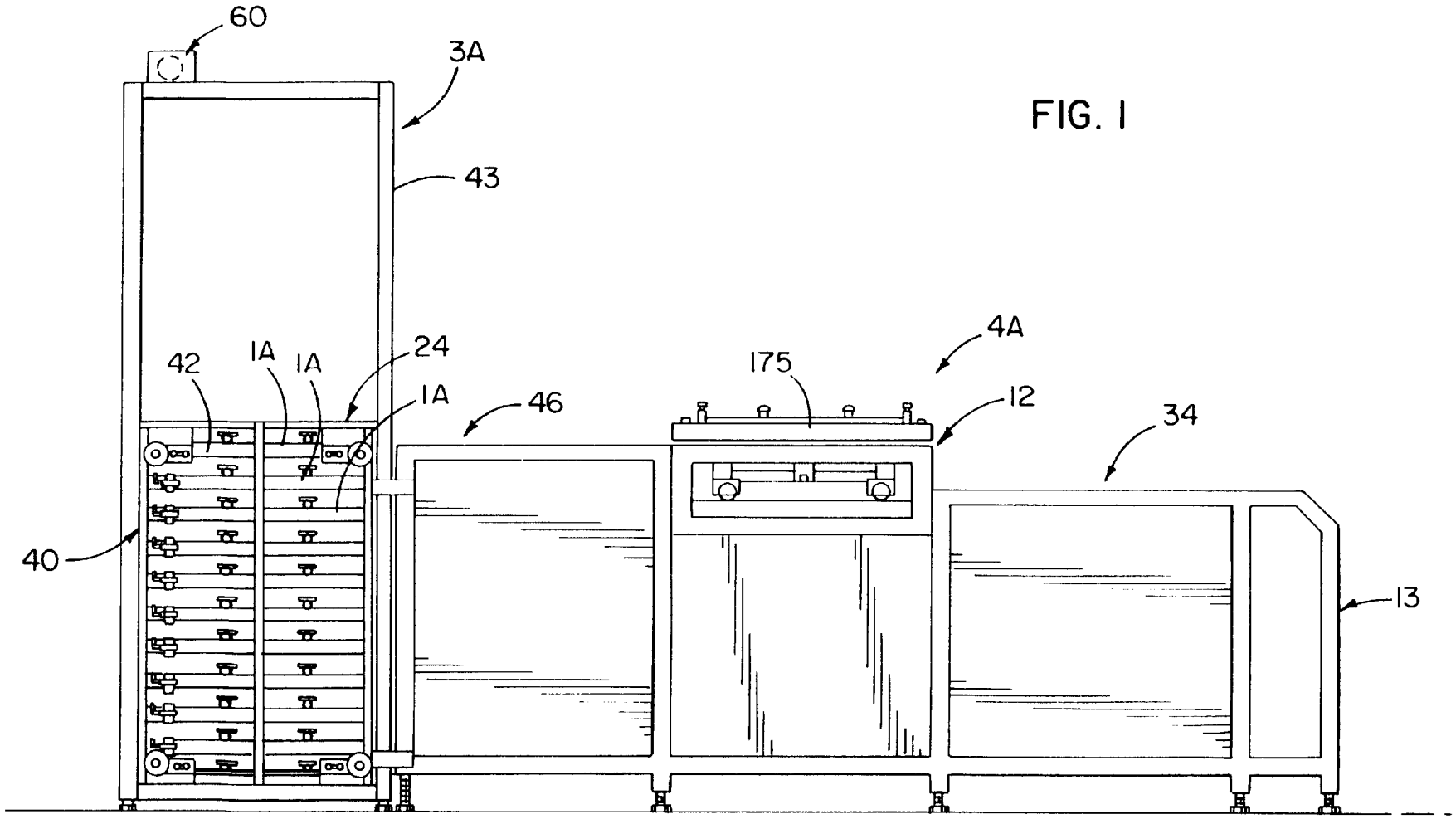
FIG. 1 is a front elevational view of a screen printing apparatus constructed in accordance with a preferred embodiment of the invention.
Figure 2:
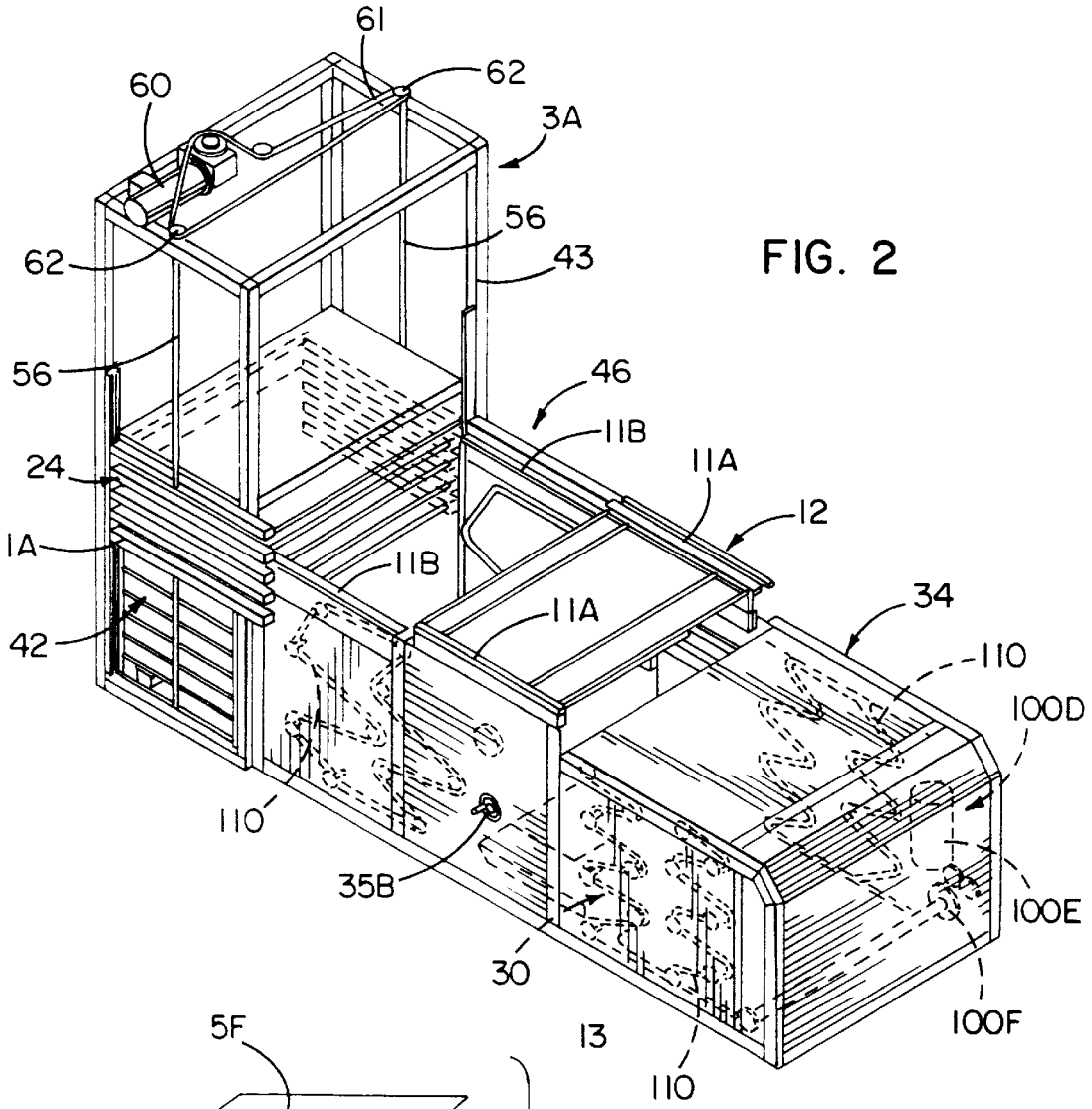
FIG. 2 is a perspective view of the apparatus of FIG. 1 showing a serpentine travel path for a pallet conveyor therein.

As will be explained in greater detail hereinafter, the platens 22 are mounted so as to always remain horizontal through their travel through a serpentine path. During travel along this serpentine path, the platens 22 travel laterally and horizontally through the setting, or curing, station 36 and then upwardly through a station which is an inspection station 37 adjacent the printing station. The substrates are loaded onto the pallets 22 at the loading and unloading station 34. As will be explained hereinafter after printing, the operator may index the pallet-conveying mechanism 30 to either reverse the travel of the substrate from the printing station to the inspection station 37, or to forward the travel of the substrate into the loading and unloading station, where the printed images may be viewed on the substrate also. In the preferred and illustrated embodiment of the invention, the cassettes are mounted in a magazine or cart 24, which is on the left side of the screen printing apparatus (FIG. 1). In the preferred embodiment of the invention, each of the cassettes 1A is mounted on a shelf 42 in a wheeled cart or magazine 40 that has the shelves 42 attached vertically therein. The removable magazine 24 is placed in a stationary frame or tower 3A. An elevator mechanism 44 lifts the entire magazine cart and all of the cassettes, when operated in a lift mode. By raising and lowering the magazine cart within the tower, a cassette 1A on each shelf is vertically indexable to bring each shelf and cassette thereon into level with a cassette transfer station 46 for lateral travel along guide tracks 11C into the printing station. As best seen in FIGS. 2 and 3, the illustrated elevator or lifting mechanism 44 is preferably in the form of a pair of threaded lead screws 56 each rotatably mounted in a nut 58 on the shelf and each turned by a motor 60. The motor drives a chain 61 and sprockets 62, which are fixed to the upper ends of the lead screws 56, to raise the entire shelving assembly of the magazine cart vertically to bring each of the shelves in seriatim fashion into the transfer station 46.

At the printing station, the cassette 1A is mounted within a cassette-registering and lowering mechanism 60 (FIGS. 12–15) which has a manually-actuatable lever 62 mounted to a shaft 64 to turn a pin locating mechanism 65A having a cam mechanism 65, in order to lower the cassette onto fixed registering pins 66 to precisely register the screen cassette for each printing operation with respect to a lifting frame 68 (FIG. 16) of the apparatus. Simultaneously, the operation of the lever 62 also causes the raising of registering pins 70 (FIG. 15) into apertures 72 (FIG. 16) on the pallet assembly 22. That is, in the preferred and illustrated embodiment, the operating of the lever 62 lowers the cassette into registered position and registers the pallet. The operator may now use a manual squeegee to force the ink through the printing screen to print the image onto the substrate. After printing, the operator then turns the lever 62 in the reverse direction, which causes the movable frame 68 (FIG. 14) supporting the cassette assembly to be rectilinearly moved upwardly along guideposts 176 at the four opposite corners and mounted within bushings 180 at the four corners for guiding the cassettes to rectilinear travel. This upward travel is a very short distance of travel, as contrasted to the very wide pivoting motion, for a typical manually-operated screen printing apparatus. After printing of one substrate, the printing station is ready for indexing of the just-printed substrate from the printing station by the pallet conveyor, and the indexing of the next pallet and substrate into the printing station. On the other hand, it is to be understood that the particular squeegee mechanism could be automated and motorized rather than be a manual operation.

In this description of the invention, the invention is discussed in the context of imprinting designs on garments. However, one skilled in the art will recognize that the invention is not so limited and that by substituting various fixtures for the platens many other types of substrates could be imprinted such as fabrics, posters, signs, and objects made of glass and metal.

Recapitulating, the subject invention involves the use of a multi-purpose pre-registration unit 2A to pre-register the print positives 4F for a job onto mesh print screens 3F. After the screens are created, the pre-registration unit 2A is also used to accurately register each of the screens within a printing cassette 1A (FIG.7A). Screens that have been registered using the cassettes should require no re-registration upon insertion into the printing press apparatus 4A (FIG. 1). For a print job involving multiple colors, the cassettes containing the screens for each color are sequentially mounted into the cart of the tower 3A adjacent to the printing apparatus 4A. To print the first color of a multi-color print, the cassette 1A containing the screen for that color is transferred from the tower 3A and accurately positioned onto the print station 12 (FIG. 1) of the printing apparatus 4A using a pin locating mechanism 65A that enables the color print to be accurately placed on a series of substrates loaded into the printing apparatus 4A. Each of the substrates is mounted on a platen 22 and is positioned at the print station 12 by a compact, serpentine, pallet carrying mechanism 30. After each substrate has received a print for a specific color, the cassette is raised from the pin locating system and transferred back into the cart within the tower 3A. The cart is raised or lowered to the cassette containing the screen for the next color, the cassette is transferred and re-positioned onto the locating pins at the print station, and the printing process is repeated again for each substrate. As each substrate traverses through the press it is cured by the flash heating unit 36 and then cooled by fans so that when it reaches the printing station it is ready for another color imprint or to be unloaded from the press at the next stop, which is the unloading station. This process and each of the components of the system of the invention will be discussed in detail below.

Figure 6:
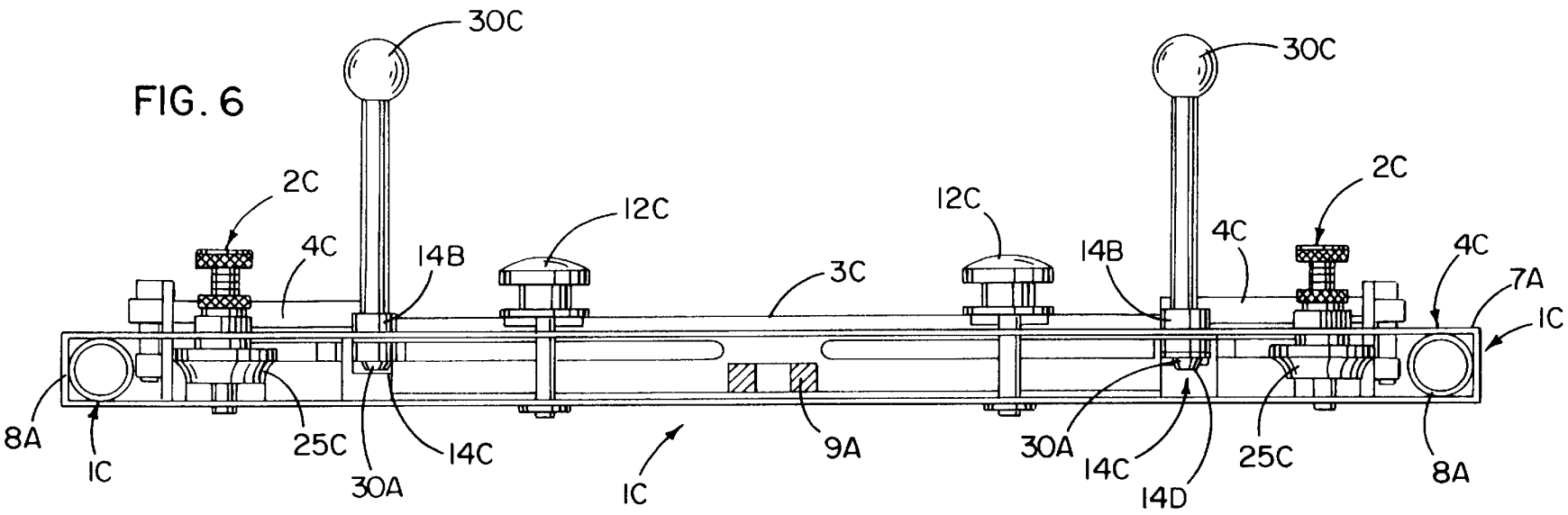
FIG. 6 is a front elevational view of the cassette of FIG. 5.
Figure 7:
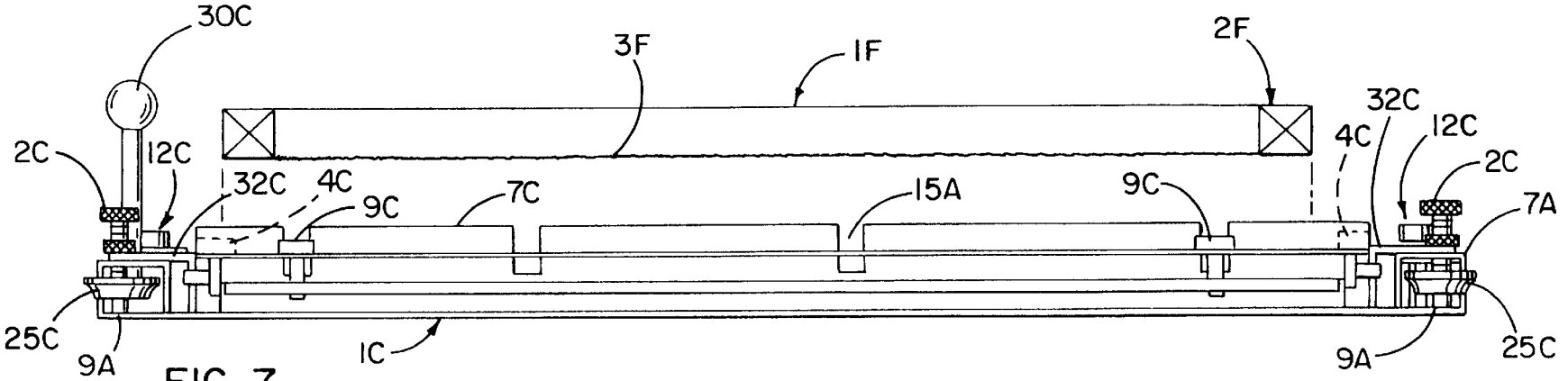
FIG. 7 illustrates an upper, inner screen frame of the cassette for positioning in a lower, outer cassette frame.
Figure 7A:
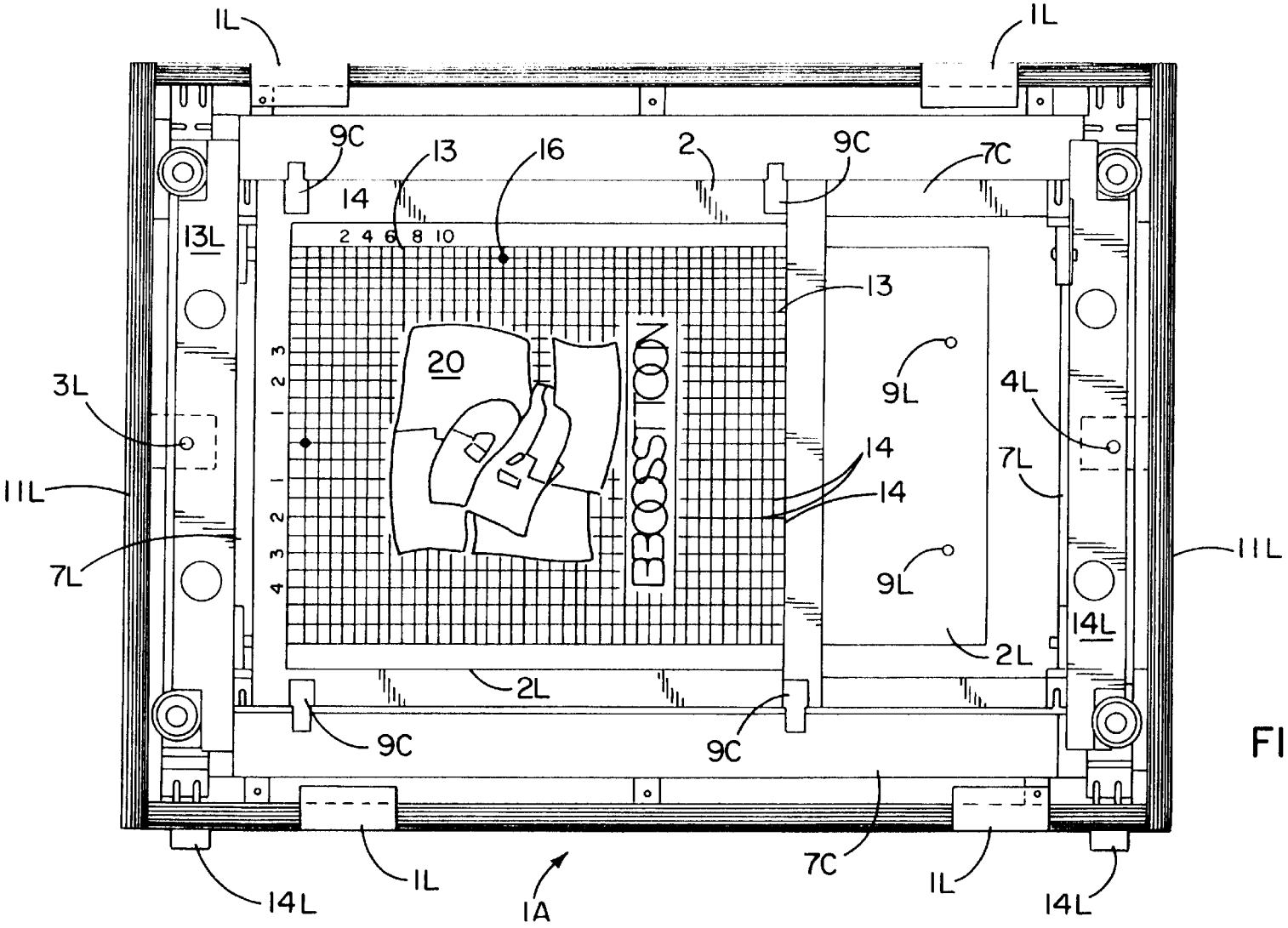
FIG. 7A is a plan view of a cassette mounted in the preregistration unit.
Figure 9:
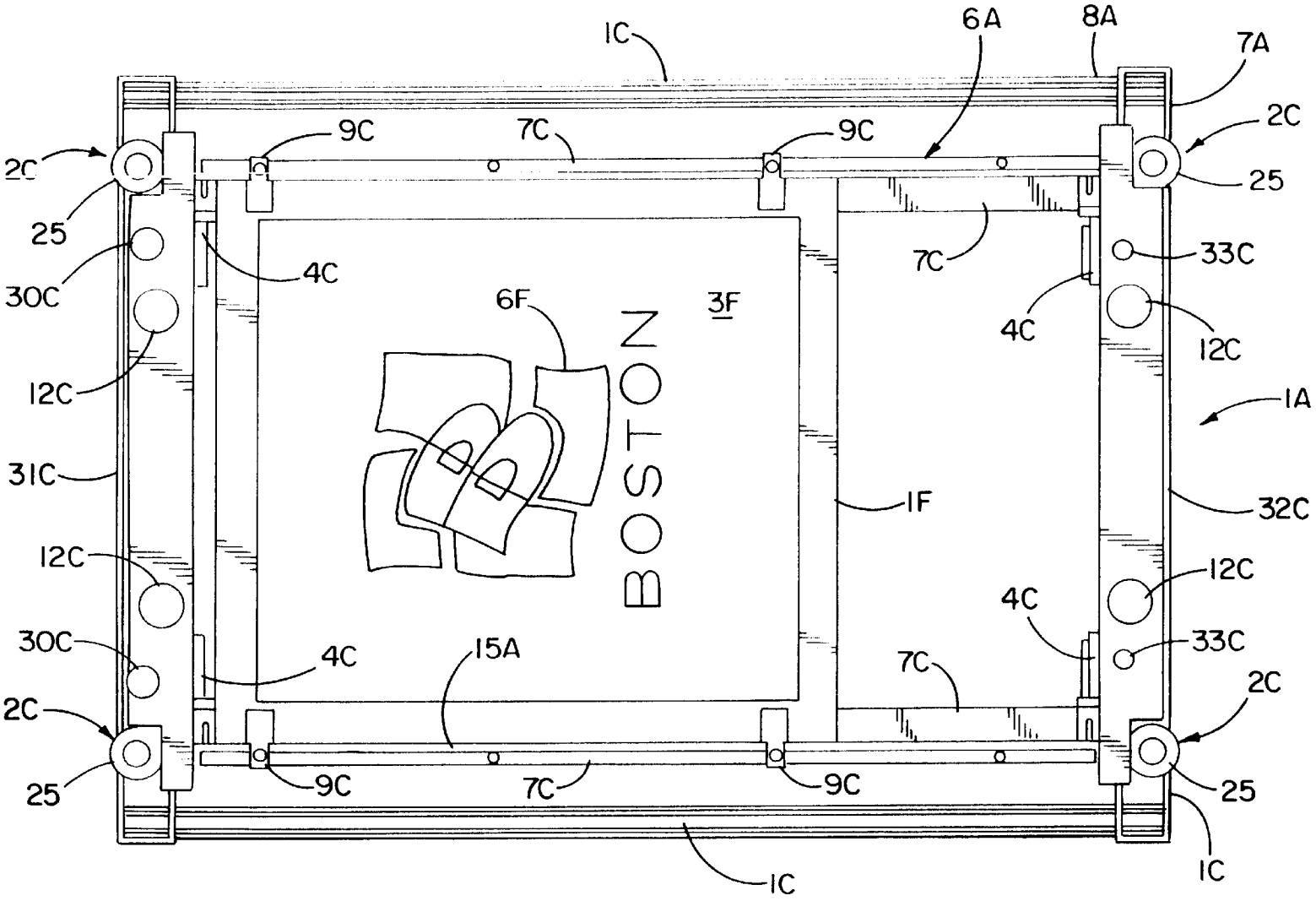
FIG. 9 is a plan view of the cassette of FIG. 7A having its image being preregistered in a preregistration unit.
Figure 9A:
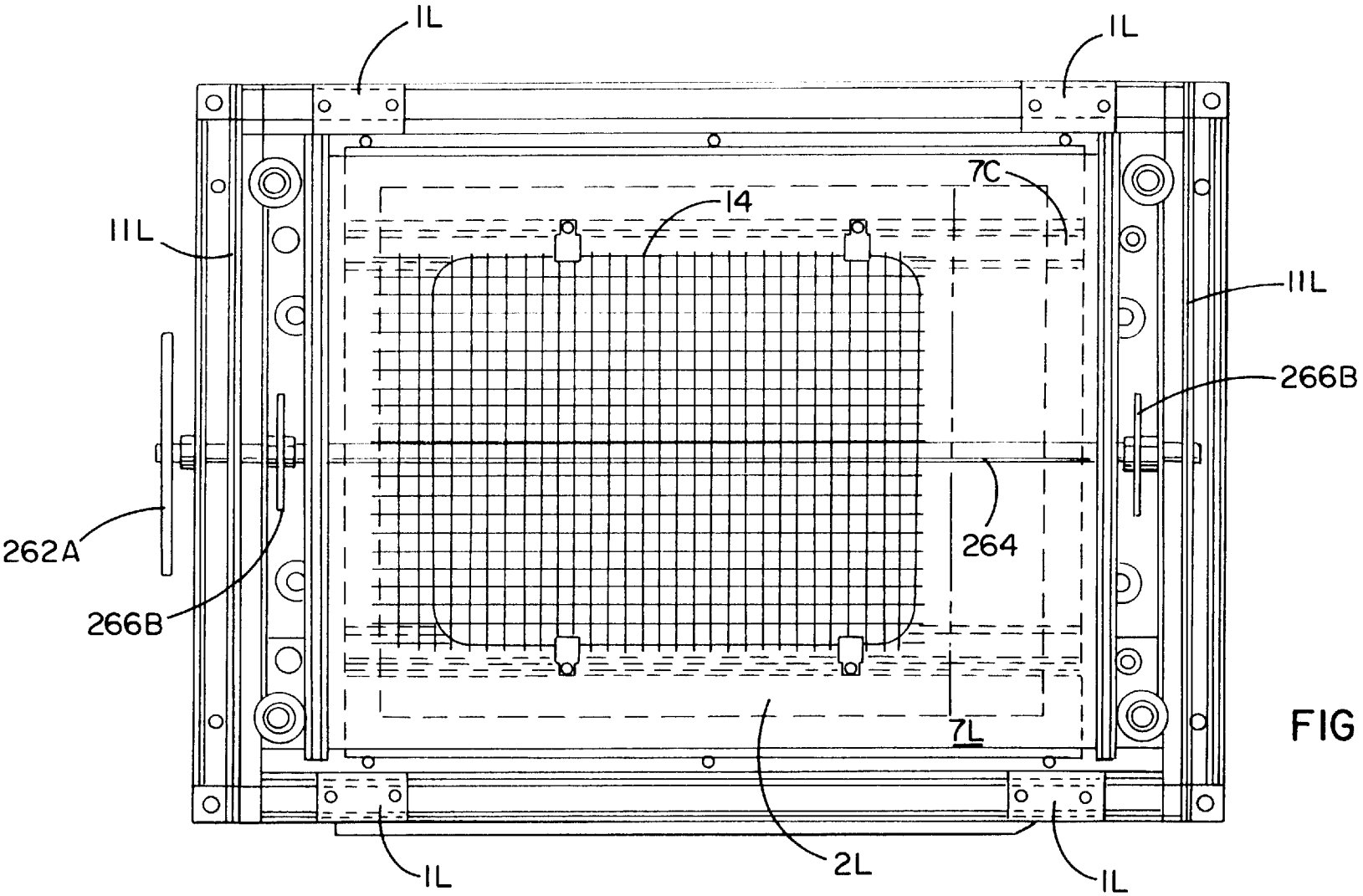
FIG. 9A is a plan view of cassette mounted on the preregistration unit of FIG. 8A.

The preferred embodiment of a cassette 1A comprises an outer rigid frame 1C enclosing an adjustable inner frame assembly 6A, as best seen in FIGS. 7 and 9. The outer rigid frame consists of two hollow rectangular tubes 7A fixably connected with two hollow round tubes 8A to form a rectangular frame. The hollow rectangular tubes 7A contain accurate locating bushings 9A to receive locating pins 3L & 4L when placed on the pre-registration table 2A or print station of the printing press apparatus 4A. Housed within each corner of the outer rigid frame 1C within the rectangular tubes 7A are adjustable wheel assemblies 2C (FIGS. 6 and 11) used to set and maintain a specific distance, referred to as the off-contact distance, between the screen mesh 3F and the substrate to be printed. The off-contact distance is set so that the screen is parallel to the substrate and will peel away from the substrate as the squeegee passes over the screen and deposits the ink for the design. When the screen is at the correct off-contact distance, it is referred to as being off-contact. Control over the off-contact distance is an important part of the print process that affects the clarity of a print, and the ability of the cassette 1A to adjust the off-contact distance at each corner adds a dimension of control to the system.

Figure 11:
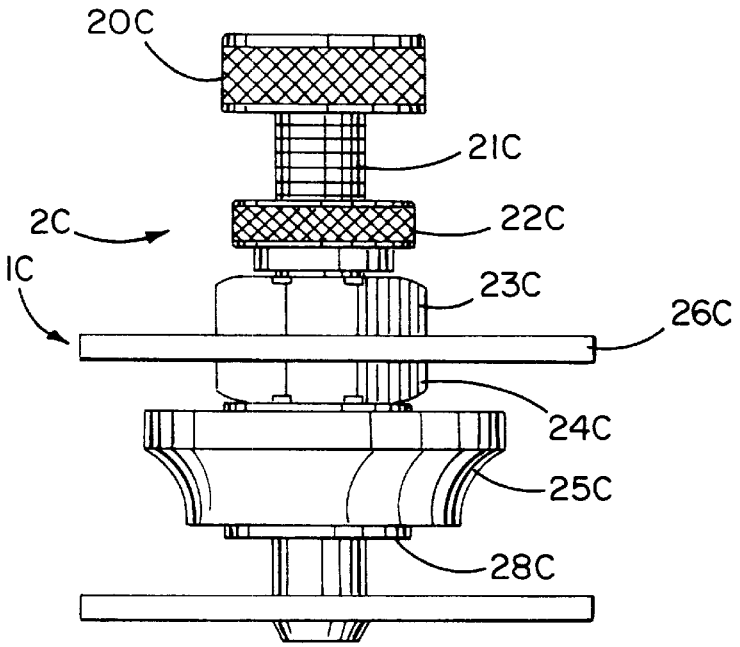
FIG. 11 is an elevational view of an off-contact adjustment and cassette traverse wheel.

A detailed view of the off-contact wheel assemblies 2C is provided in FIG. 11. The off-contact distance is set by using a knurled knob 20C to turn a threaded shaft 21C that raises or lowers the wheel 25C relative to a member 26C of the rigid frame 1C. On the threaded shaft 21C is a lock down nut 22C to lock the shaft from turning and hold the cassette thereby at the set height. The wheels 25C have a concave radius or any contour that mates with the tracks 11L (FIG. 5A) on the pre-registration unit and the tracks 11B on the printing apparatus. The mating of the four wheels 25C with the track 11L supports and holds the cassette in place during preregistration. The wheels 25C with the wheel assemblies 2C also facilitate the transfer of the cassette 1A from the tower 3A to the print station of the press 4. The cassette is transported via tracks 11b leading from the tower 3A to the print station 12 that have a convex radius similar to that of the track 11L (FIG. 11) on the preregistration unit 2A. The mating of the four wheels with the track 11*a* or 11*b* restricts unwanted movement of the cassette front to back on the printing apparatus 4A while providing a rolling motion along the track length. The wheels also rest on the sides of the rails at the printing station to locate the screen at the preset off-contact distance when printing.

As shown in FIG. 9, the adjustable inner frame assembly 6A of the cassette 1A consists of two slidable shelved rails 7C connected at each end to front and back macro plates 32C, which slide on tubes 7A of the outer frame 1C. The shelves are adjustable laterally through the use of lockable sliders 4C to accommodate different size print frames 1F. The shelved rails 7C also have slots 15A in them for the placement of lock down clamps 9C to hold the screen frame in place. The macro plates 32C (FIG. 6) can slidably move across the rectangular tubes 7A of the outer rigid frame 1C providing a mechanism for adjustment of the slidable shelved rails 7C relative to the outer rigid frame 1C. This adjustment is accomplished in a unique fashion using a joystick micro-registration system discussed below.

Figure 5:
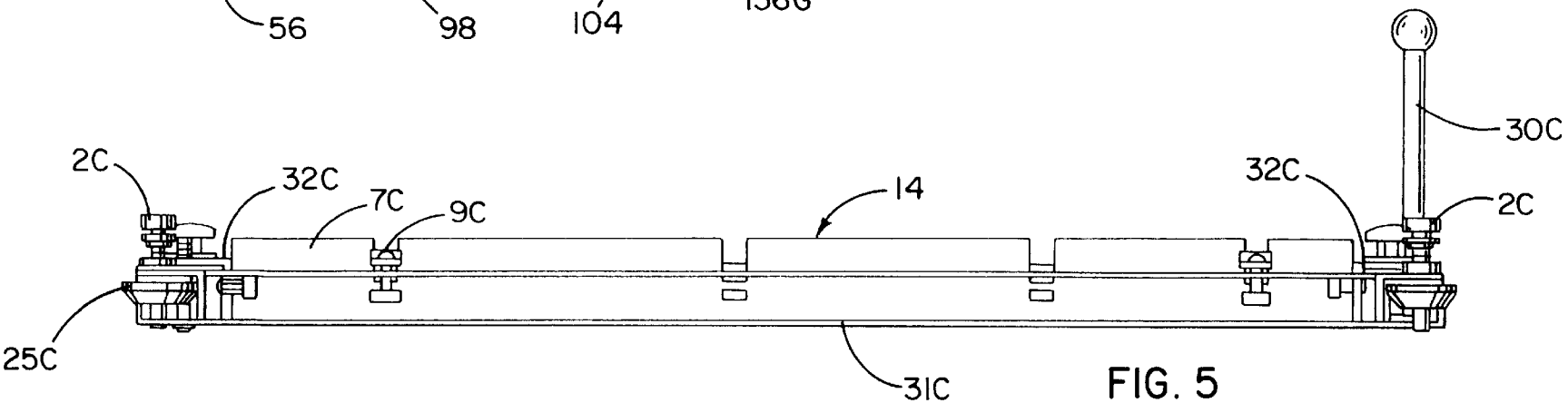
FIG. 5 is a side elevational view of a cassette constructed in accordance with a preferred embodiment of the invention, and with a joystick mechanism mounted thereon.

As depicted in FIG. 5, the invention uses a separate multi-purpose pre-registration unit 2A to simplify and speed up the preparation and registration of the screens. Pre-preparation of the screens and pre-registration of the positives is critical to the print process and represents one of the most time-consuming steps in a screen printing job. The use of a separate pre-registration unit eliminates downtime associated with registering the screens at the press and permits the concurrent use of personnel; one person can be setting up jobs at the pre-registration unit while the other person is printing at the press. It also removes the requirement that the press operator be skilled at registration of images. This allows an organization to economically structure its personnel requirements. The pre-registration unit also results in better organization and productivity because it permits a pre-prep person, to set up many jobs ahead of time so they are ready when needed by the press operator.

Figure 8:
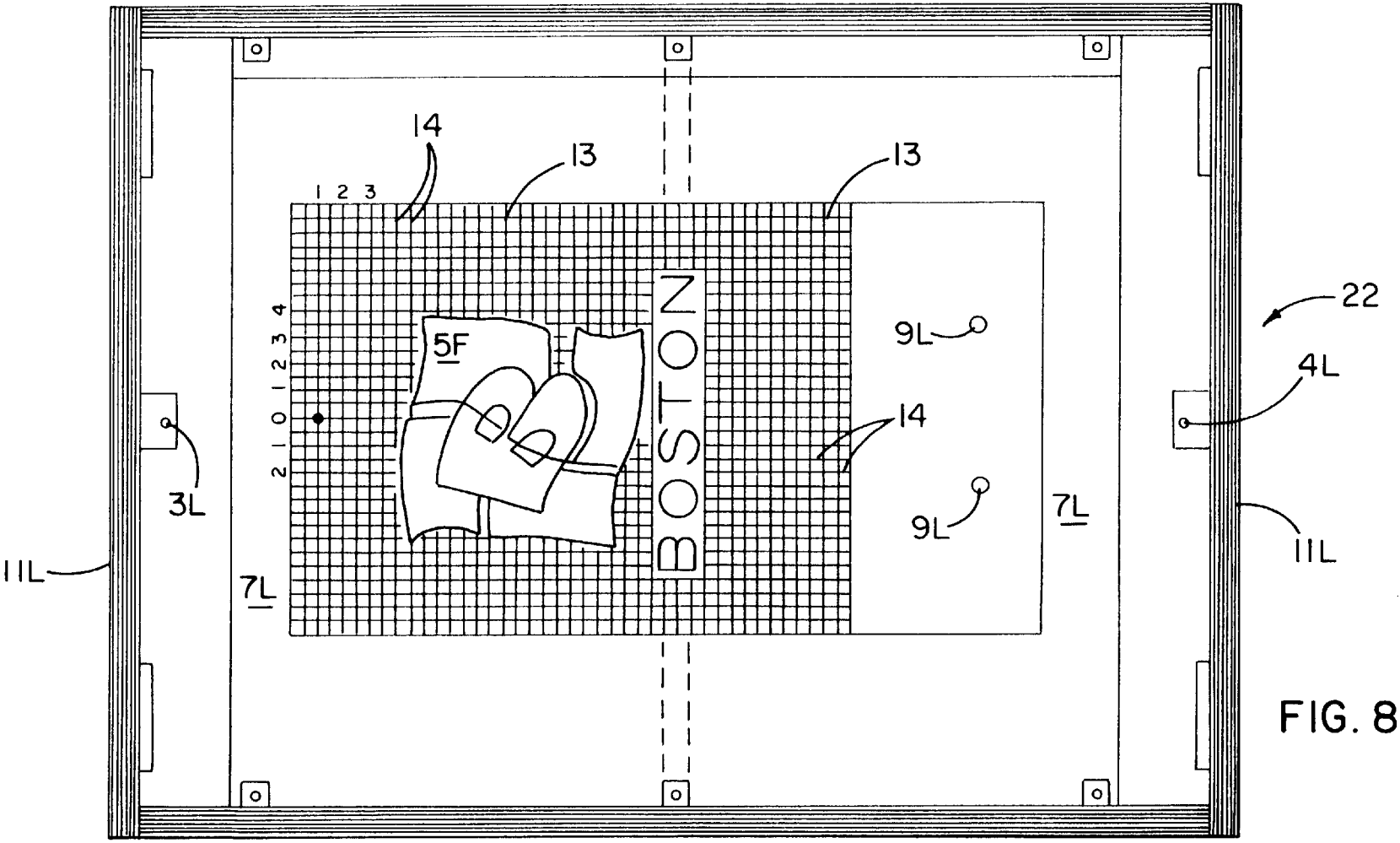
FIG. 8 is a plan view of the preregistration unit.
Figure 8A:
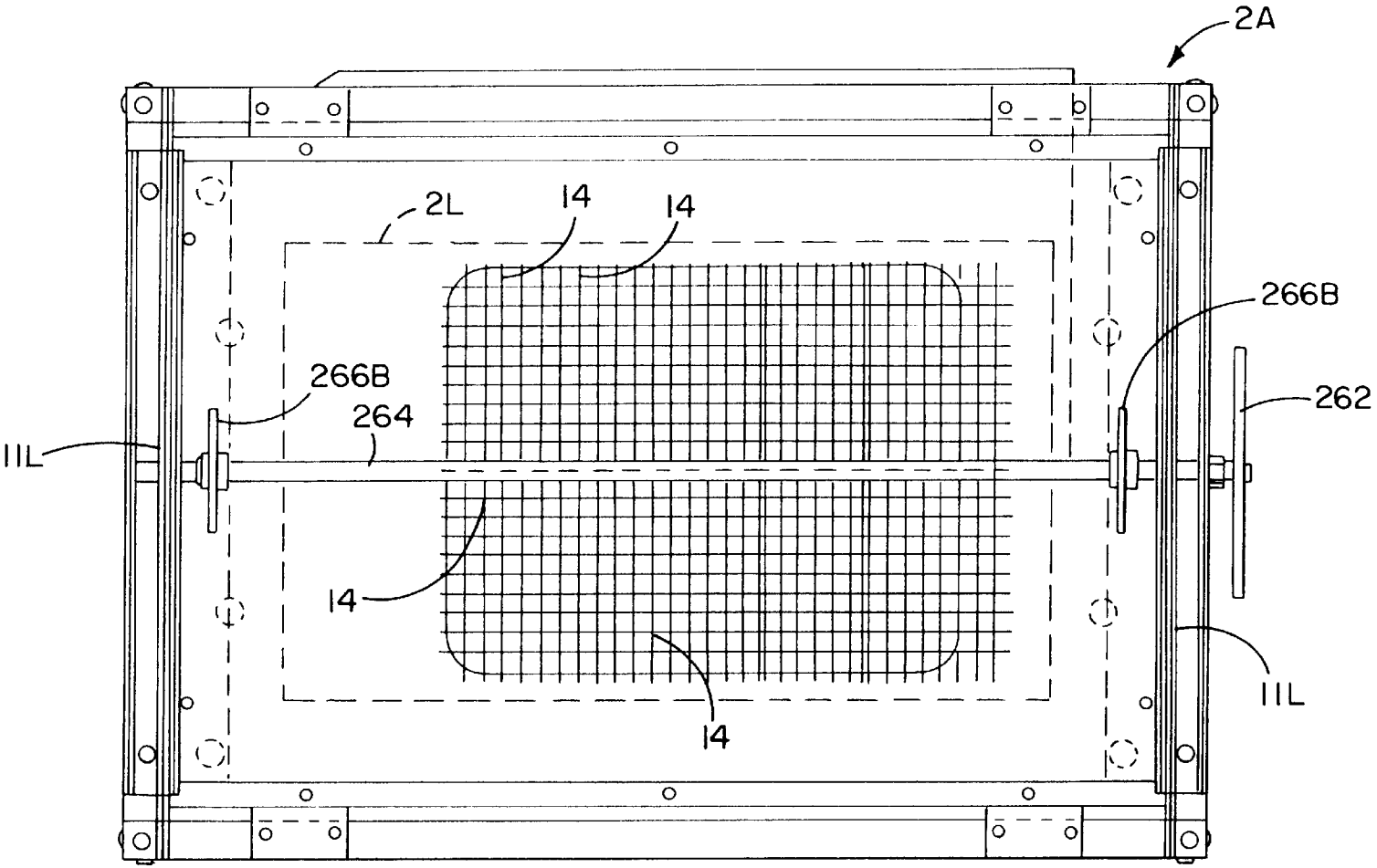
FIG. 8A is a plan view similar to FIG. 8 of the preregistration unit.

The preferred embodiment of the pre-registration unit 2A is depicted in FIGS. 5A, 7A, 8 and 18. The pre-registration unit consists essentially of a light table having a rigid frame 12L supporting a sheet of translucent plexiglass 7L (FIG. 5A). A light source, such as a set of four fluorescent lamps 34L, is mounted to the rigid frame 12L using standard lamp holders in such a way as to direct light upward through the translucent plexiglass 7L. A grid registration platen 2L made of the same translucent or clear plexiglass is mounted on the top of the sheet of translucent plexiglass 7L by the use of 3 locating pins or dowels 9L. The grid registration platen 2L can be quickly and easily removed and comes in several sizes that correspond to the various sizes of the platens 22 that are mounted in the conveyor mechanism of the printing press 4A and support the substrates to be printed. The grid registration platen 2L is marked with an outline of the printing platen containing centering and common print design heights and a grid of intersecting lines 13 (FIGS. 7A and 8). In one embodiment of the invention the lines of the grid are spaced ½ inch apart. At the intersection of each of the grid lines is a small hole 14. Each grid line is identified by a number or letter (1, 2, 3, etc.) so that each hole can be identified with two intersecting lines. The intersecting grid of holes as well as the lights 34L directly under the positives differentiates the subject invention from existing off-press registration systems and permits easier viewing and layout of the positives.

One half inch rounded track 11L is mounted to the rigid frame 12L of the pre-registration unit as shown in FIGS. 5A and 8. The mating of the track 11L with the four wheels 25C on the wheeled assemblies 2C of the cassette supports and holds the cassette in place during pre-registration. Travel on the track is limited by four angle brackets 1L (FIG. 7A) located at each corner of the pre-registration unit. These brackets 1L restrict movement of the cassette so that it remains in close proximity to the cassette locating pins 3L&4L. After the cassette is placed by hand, on the tracks 11L, the cassette locating pins 3L&4L can be raised and received in the locating bushings of the cassette to accurately position the cassette relative to the grid registration platen 2L. The cassette locating pins 3L & 4L are raised and lowered by a turning a crank lever 262 (FIG. 18) which activates a cam system that moves the pins. The cassette locating pin system 3L&4L on the preregistration unit 2A is substantially the same as the cassette locating pin system (FIGS. 13–15) at the print station 12 of the printing press 4A so that the location of the grid registration platen 2L of the preregistration unit 2A corresponds directly with the location of the platens 22 at the print station 12 of the printing press 4A. As a result, images that are registered in a cassette 1A at the preregistration unit 2A will be registered at the print station 12 of the press. This ability to pre-register a screen in a cassette on the preregistration unit represents a significant improvement over the prior art and eliminates the need to use time at the press for registration.

Referring to FIG. 8, to accurately set up and pre-register screens 3F from the artwork positives the operator first chooses the necessary gridline holes 14 that do not intercept the artwork design 5F. In the preferred embodiment of the invention, three platen locating pins consisting of commercially available metallic pins are used although a different number of pins could be used. The keyline positive is then taped to the platen 2L and a second positive is layered on top of and aligned with the keyline positive and taped down. The three platen locating pins are then punched through the two positives and into the selected holes 9L in the grid registration platen 2L. After removing the platen locating pins from the holes 9L, the top positive is carefully removed and the procedure is repeated for the remaining positives. Upon completion, all of the positives 4F will be pre-registered with the keyline and with each other. The three holes 9L permit each positive to be separately handled but still maintain alignment with the other positives and the keyline because each positive carries its own very accurate registration system after it has been punched. Due to the three punched holes 9L the positives remain in register with each other thus drastically reducing the time it takes to re-register the screens for a reprint and giving the prepress person flexibility in setting up their schedule. As a result, the operator can place the positives in their job jacket and make the print screens at a later date without need for further alignment with the rest of the design. Similarly, when it comes time for final registration of a screen prior to printing, or if it is necessary to redo a screen because it has been lost or damaged or worn out, all color separated positive alignment is already completed, the operator merely has to locate the punched holes from the recorded coordinates and insert the platen pins in the holes 9L to put the design exactly back into its previous position, without having to use any of the other positives in the job for reference.

The preregistration system of the invention is simpler and more accurate than existing systems and does not require a carry sheet. It also saves time when putting the print screens 3F into final registration. In most cases the screens 3F that have been pre-registered using the invention can be put right back into a cassette and are ready to use on the press with very little adjustment, particularly if metal screens are used. If the screens need to be registered, the operator has the option of using the preregistration unit or registering the screen right on the printing press apparatus.

When the printer decides to create screens from the preregistered positives, a screen 3F must first be loaded into a cassette 1A. As shown in FIGS. 7 and 7A, a print screen consisting of a screen frame 2F and a emulsion prepared screen 3F is placed on the shelved rails 7C of the adjustable inner frame assembly 6A of the cassette, the rails 7C are adjusted to the width of the frame 2F and the lockable sliders 4C are tightened. The frame 2F is then clamped to the rails 7C using lock downs 9C. The off-contact wheel assemblies 2C are then adjusted to bring the screen mesh 3F in direct contact with the grid registration platen 2L. Then, the four corner wheel assemblies 2C are adjusted to lift the screen mesh and to maintain the screen parallel to and off contact with the grid registration platen 2L. The relative distance between the grid registration platen 2L and cassette tracks 11L on the preregistration table 2A as compared to the distance between the platens 22 and cassette tracks 11*b* at the print head dictate the screen mesh off contact distance from the substrate. Once the screen frame 1F has been mounted and off-contact distance set, the cassette can be removed and set aside while the positive 4F is set up.

To set up a positive 4F, the desired positive 4F is realigned with the chosen holes 9L on the grid registration platen 2L of the preregistration unit 2A (as noted on the keyline) and the three platen locating pins are reinserted. The operator places pieces of adhesive tape with its adhesive side facing up on the back side of the positive 4F at the four corners so that the tape extends beyond the edges of the positive. The operator then tapes down the positive to the grid registration platen 2L using two small pieces of tape having less than ⅓ of the tape actually secured to the grid registration platen 2L and ⅔ of the tape secured to the positive 4F. This small amount of adhesion with the grid registration platen 2L will hold the positive in place when the platen locating pins are removed but will let go when the screen 3F that is placed on the positive 4F is lifted away due to the fact that the larger pieces of tape facing up at the corners adhere securely to the screen.

Once the positive 4F has been positioned and taped, the platen locating pins are removed. Then, the cassette locating pins 3L & 4L are raised. A cassette 1A containing a mounted screen frame 1F is seated on the front and back cassette locating pins 3L & 4L thus bringing the screen 3F mounted in the cassette into contact with the positive 4F. The operator then rubs the screen 3F at the locations where the upside down adhesive tape is located to adhere the positive 4F to the screen. The lock down 9C of the cassette are then loosened so that the screen frame 2F can be lifted from the cassette. In the event that the positive 4F shifts during the removal, the positive can be realigned using the platen locating pins and holes 9L and the adhesion and lifting process repeated. After the positive is secured to the screen, the screen frame is taken to a device to expose the positive on the screen and create a [negative] image using methods well known in the screen printing arts. This set up process is repeated for each positive in the job.

The preregistration unit 2A can also be used to pinhole and tape print screens 3F after they have been exposed and dried thus reducing the amount of extra equipment needed by the pre-press operator. To do so, an empty cassette 1A is loaded onto the tracks 11L of the preregistration unit then pivoted upward and held in place angularly above the translucent plexiglass 7L. The exposed print screen 1F to be pinholed or taped is then mounted upside down in the adjustable inner assembly 6A of the cassette and lock downs 9C are used to clamp the screen 2F in place. The lights 34L under the translucent plexiglass 7L will illuminate any holes or worn spots in the screen 1F mounted in the cassette. Because the cassette and translucent light plexiglass 7L are angularly displaced from one another, the light from the preregistration unit strikes the screen at an angle causing pinholes to be accented and easily visible to the operator. After taping or pinholing is complete, the operator loosens the lock downs 9C and the shelved rails 7C if necessary so that the screen frame 2F can be lifted from the cassette. The operator can then insert into the same cassette or use another print screen and continue pinholing and taping until all screens are done. The ability to use the preregistration unit as a pinholing and taping station is an improvement over most prior art as the average screen printer does not wish to spend the extra money for a separate pin holing station and often does not have the room for such equipment anyway.

The preregistration unit 2A and cassette 1A of the invention can be used to place almost any type of print screen, whether existing or prepared in accordance with the preregistration procedure, in final registration for use on the printing apparatus 4A. In the event that the screen was not prepared using the preregistration process the operator will need to preregister and punch the positives using the method described above. To place a pre-exposed screen 1F into register using the preregistration unit 2A (see FIG. 7A), the positive 4F corresponding to that screen is realigned with the chosen holes 9L on the grid registration platen 2L of the preregistration unit and the three platen pins are reinserted into the holes 9L. After taping down the positive 4F, the pins are removed and a cassette 1A is seated over the front and back raised locating pins 3L & 4L. The screen frame 1F containing the corresponding [negative] is then inserted into the cassette 1A and is secured using the lock downs 9C. The operator can then check to see if the positive and negative are in register.

If additional registration is needed, the joystick micro-registration system, detailed in FIG. 6, is available to quickly and precisely register the images. In the default reference position, the inner frame and outer frames 7A are held in fixed, centered position by hitch pins inserted in holes 33C through the macro plates 32C and rigid outer frame 1C. To enable the joystick micro-registration system the operator first removes the hitch pins and loosens the lock down knobs 12C. Loosening the lock down knobs 12C permits the macro plates 32C to slidably move across the rectangular tubes 7A of the outer rigid frame 1C. Mounted in the rigid frame 1C are two spherical bearings 14C with two spherical bearings 14C mounted above them in the macro plates 32C. Adjustment of the relative position of the inner frame 6A and the screen frame 1F clamped thereto is accomplished by placing two joystick rods 30C through the bores in upper bearing blocks 14B on the inner frame 6A and manipulating the rods to attain the required relative position of the inner 6A and outer 1C frames and put the screen in precise register with the positive. While holding on to both joysticks the operator moves the joysticks 30C in whatever direction he or she needs to align the screen and the positive. To move the screen in a 45 degree angle, a task which is difficult under the prior art, merely requires that the operator aim the joysticks in the 45 degree angle or any other angle the operator wishes. The operator can also use one joystick 30C while holding the other one still to achieve a very fine adjustment. Alternatively, he can slightly tighten one of the lock down knobs 12C and use the other joystick 30C to make the adjustment. In addition, in the preferred embodiment the use of joysticks 30C that are 7 inches tall provides a precise movement ratio of 1.5 to 1 further enhancing the ease of use of the micro-joystick registration method.

As best seen in FIG. 6, lower ends 30A of the joystick rods 30C are seated on semi-spherical bearing surfaces 14B of the stationary bearings 14C fixed to the rigid stationary outer frame. The upper bearings 14B have bores receiving the insert joystick shafts to allow the lower ends 30A of the joysticks to abut the semispherical bearing surfaces. The operator grasps the rounded, distal handle ends of the joysticks and pivots them about their lower ends 30A with the shafts of the joysticks pushing on the upper bearings 14B and displacing these upper bearings in the direction of the angular movement of the respective rods 30C. After registration, the knobs 12C are operated to change and secure the inner frame to the outer frame; and the joysticks are pulled from the upper and lower bearings and set aside until needed again.

The joystick micro-registration system is an improvement over existing micro-registration systems in the prior art which require the delicate manipulation of knobs and clamps with limited X and Y movement. In addition to enabling movement of the screen in very small, smooth increments, the joystick micro-registration system permits a full 360 degree range of movement. Under existing systems, lateral movement requires the person who is using the micro-registration system to try and create the lateral movement by putting pressure in one direction while turning the other knob in opposite direction; this technique is difficult, and in most cases results in redoing the registration over and over to achieve the desired results.

Once the required position is attained and the positive is in registration, the inner 6A (FIG. 7A) and outer 1C frames of the cassette are locked together by tightening the lock down knobs 12C and removing the joysticks 30C from the spherical bearings. Tightening the lock down knobs 12C prevents further adjustment permitting the cassette 1A and registered screen to be removed from the pre-registration unit 2A and placed in the tower 3A (FIG. 1). The process is repeated until all positives and the screens are in precise register for that job.

One of the big advantages of the invention is the use of cassettes for final registration of the print screens in a job. Once the screen 1F in the cassette 1A has been registered, the cassette can be mounted into the mounting assembly at the print station 12 of the printing press 4A without need for further registration or adjustment by the operator. The fact that no additional registration is needed at the press results in a significant reduction in press down time and is a significant improvement over the prior art. A common problem faced by screen printers, with current machine designs that clamp screen frames at the back or furthest position from the operator, is the use of different size screens for various colors in a job. This is not a problem for the subject invention, as the cassettes 1A will accept just about any size screen commonly used in the screen printing industry. Because of the method of firmly clamping the screen frame into the cassette, the cassettes can also be used to accurately register screen frames of various conditions, including warped and damaged frames, regardless of the method used to create the screen in the first place. The invention thus saves time in printing repetitive jobs and the reusing of stored screens, and in most cases, old screens can be registered more quickly than the first time they were registered using another printing system.

As explained above, the preferred embodiment of the printing press consists of a rectangular framework housing 13, a print station assembly, a platen carrier or conveyor drive 30, curing unit 36 and cooling unit 37. The printing operation is performed manually with motorized assistance in the delivery of the platens to the print station by the conveyor mechanism 30. Attached to one end of the press is the motorized tower 3A used for raising and lowering the cart 24 storing a plurality of cassettes.

The print station assembly consists of a rectangular framework 14 machined to precise dimensions that position the platen carriers and cassettes. The print station is designed to lower a mounted cassette onto stationary cassette guide pins 66 and simultaneously raise platen carrier guide pins 70 into receivers 72 mounted on each platen carrier. This motion is provided by turning the lever 62 that rotates two eccentric cams 65. The print station is guided by four vertical shafts 176 sliding in sleeve bearing assemblies 180 aiding the accurate positioning of both the platen carrier and cassette.

Figure 4:
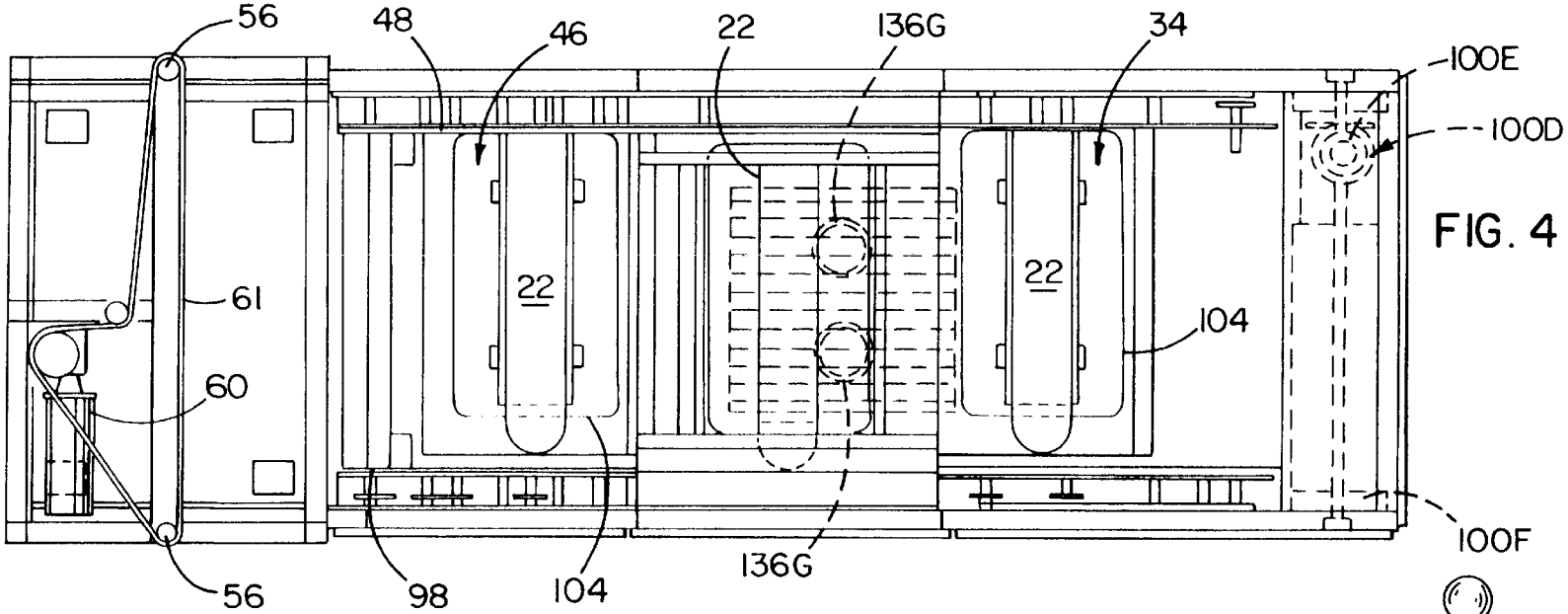
FIG. 4 is a plan view of the screen printing apparatus of FIG. 1.

The structure of the printing press and the serpentine drive are shown in FIG. 3. The conveyor mechanism 30 for advancing the platen carriers 100 (FIG. 16) consists of a motor driven reducer providing equal driving forces and speeds to carrier chains 110 mounted on the front and rear of the printer frame. As best seen in FIGS. 3 and 4, a motor drive 100D for the carrier chains 110 includes a motor 100E driving a gear and sprocket unit 100F having sprockets driving the respective carrier chains 110. The platen carriers are attached to the carrier chain 110 through wheel axles 108 mounted to a chain link. Diagonally opposing wheel axles attached to the chain, guided with the remaining two wheels 106 of the platen carrier through serpentine guide plates, allow the platen carrier to be traversed in a horizontal position throughout the complete cycle of the machine. The serpentine travel path of the platens 22 allow more platens 22 to be positioned along the chain in less overall space than if a straight path were taken by the carrier chain. This gives the printer with minimal floor space the same or greater printing capacity than a printer with larger facilities.

Figure 16:
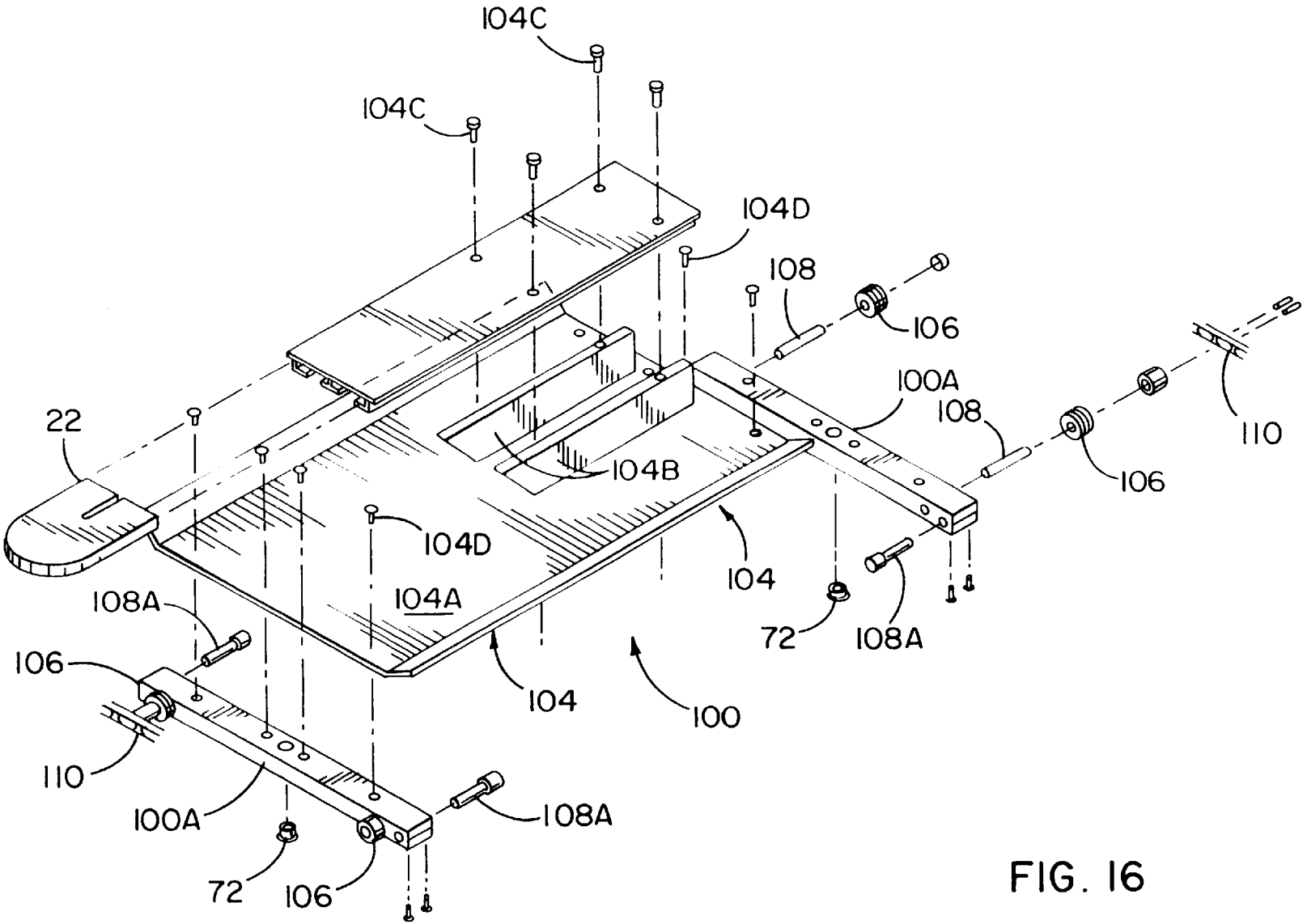
FIG. 16 is an exploded view of a pallet support cart assembly of the pallet conveyor and of the registering mechanism for the pallet support cart.

The platens 22 are mounted on platen carriers 100 (FIG. 16) which traverse within the frame through the operation of the conveyor mechanisms 30. In the preferred embodiment there are ten platens 22 although one skilled in the art will be able to see that this number could be increased or decreased. As shown in [FIG. 16], the platen carriers 100 consist of a platen mount 103 and a catch basin 104 to hold the substrates excess material (i.e. sleeves and back side of a garment) and to prevent contact with the frame of the press. As best seen in FIG. 16, the catch basin includes a horizontal, rectangular plate 104A and a pair of short vertical, bars 104B secured to the plate 104A. The bars support the pallet laid thereon and attached thereto by screws 104C. The plate 104A is secured by screws 104D to a pair of carrier spaced bars 100A that carry four wheels 106, with two wheels 106 being mounted on each carrier bar 100A. The platen carrier 100 is guided by these four wheels 106 mounted on eccentric axles 108 fixed to the carrier bars. The eccentric axles are used to position the platen carrier level with the machine without added expensive manufacturing costs. Two diagonally opposing axles 108 are used to attach the platen carrier 100 to the carrier chain 100. The platens 22 are interchangeable with other size platens by unfastening one platen 22 and substituting another platen therefor.

The platen conveyor 30 can be controlled by a foot switch or push button (not shown). In normal operation, pressing the foot switch or push button, causes the motor to position the next platen 22 to the print station 12. The platen carrier wheel axles 108 (FIG. 16) engage the chain pulling the platen carriers along the serpentine track. When a platen approaches the print head, it activates a series of two sensors which cause the conveyor drive to slow to an approach speed and stop when the platen has moved over the locating pins 70 at the print station. The drive can be operated in either direction by setting a motor direction switch. In addition to advancing the platens one platen position at a time using the foot switch or push button, the platen can be set to traverse in a timed mode, automatically advancing at operator set intervals.

The tower 3A is attached to the printing press apparatus 4A. The tower has a rigid frame 120 which is attachable to the printer. Mounted on the four vertical frame members 121 are of the rigid frame guides used in maintaining containment of the moveable magazine cart 24 internal to the tower structure. The cart 24 holds a plurality of cassettes in a vertical or magazine style configuration. The cassettes are loaded onto tracks or shelves 42 in the cart enabling a printer to load multiple jobs into the cart in the tower. Two motor driven screws 56 raise and lower the cart to the desired cassette loading and unloading positions. The cart is also removable from the tower and can be remotely loaded and unloaded and brought to the tower for exchange with another cart. In the preferred embodiment there are 10 cassette positions although one skilled in the art will be able to see that this number could be increased or decreased.

The ability to load multiple jobs into the magazine cart 24 for later use is a real time savings and helps with the organization of the jobs for the day. By being able to load multiple jobs into the cart of the tower, the person who schedules print jobs can better set up which job is to be printed first and which one last. In this manner the scheduler has a way of lining up and setting up the jobs for the entire day thus leading to better organization and time/cost management. The multiple screen capacity of the tower cart makes it very easy to have multiple jobs set-up and waiting to be printed. For example, to run 2 four color jobs and 2 three color jobs on a 6 color rotary press would involve tearing down the press 2 times and setting it up 3 times while the preferred embodiment of the subject invention would merely entail loading the cassettes for all jobs into the cart and loading the cart into the tower. No tearing down of the system is necessary. During operation of the system, it is possible to swap out the cassettes for a particular job individually or to insert a new fully loaded cart into the tower.

Many screen printing jobs involve large numbers of various small volume jobs. It is thus important that a screen printing system be highly adaptable and permit quick and easy change over between jobs, designs and imprint materials. In the present invention the cassettes can be easily transferred between the tower and printing station via tracks, providing the powerful ability to change jobs quickly with negligible downtime associated with current art registration of the job on the press. This ability also permits the operator to easily print a sample run to proof a job for a customer. Once the samples are printed, the operator can leave the cassettes in the tower and move on to the next job. There is no need to hold up the press waiting for the customer to approve the samples. When the customer approves the proofs, the operator can go back and do the production run with no press downtime and without having to re-register any of the designs on the press.

Figure 13:
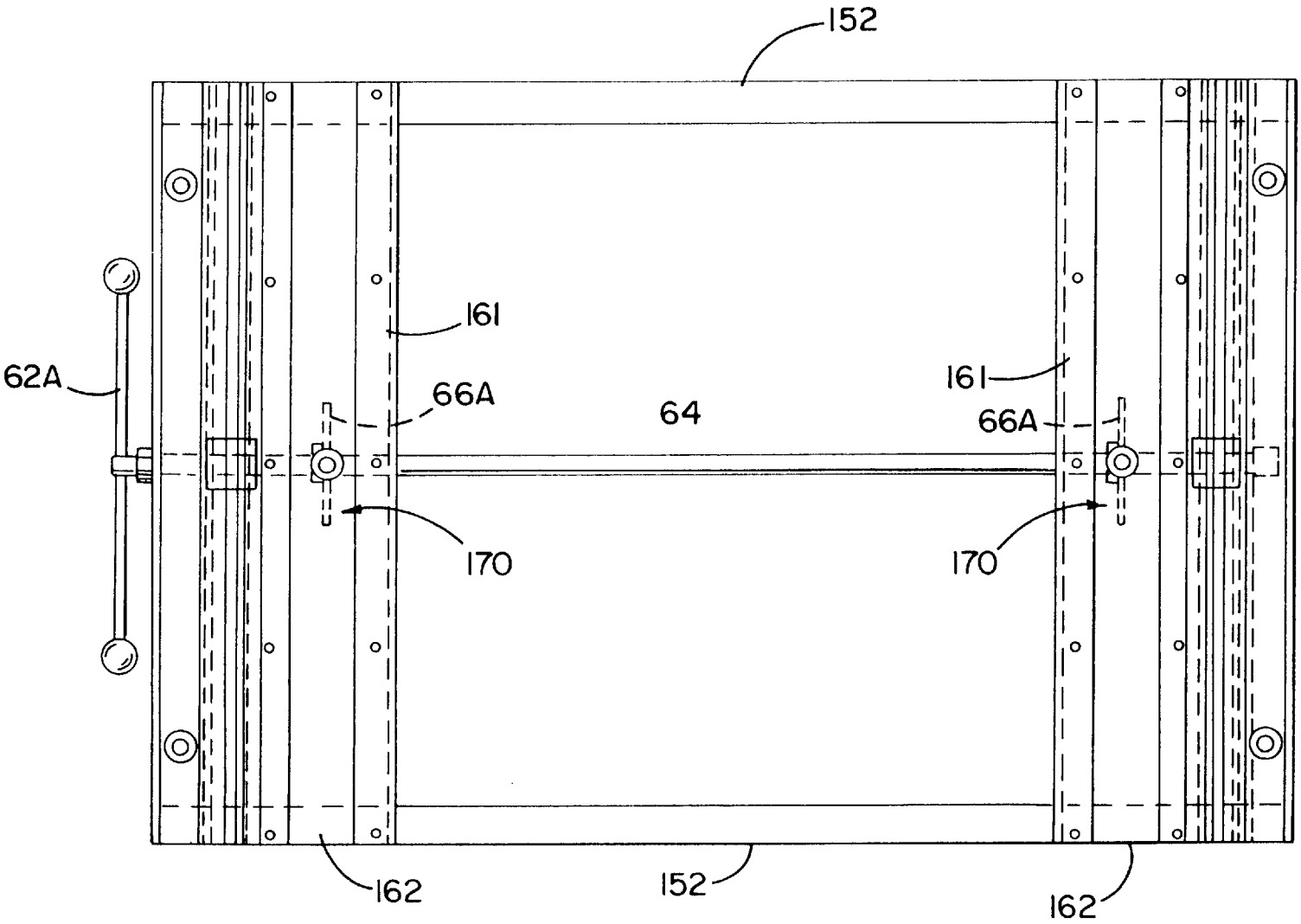
FIG. 13 is a plan view of the printing station showing the cassette support and registering mechanism of FIG. 12.
Figure 14:
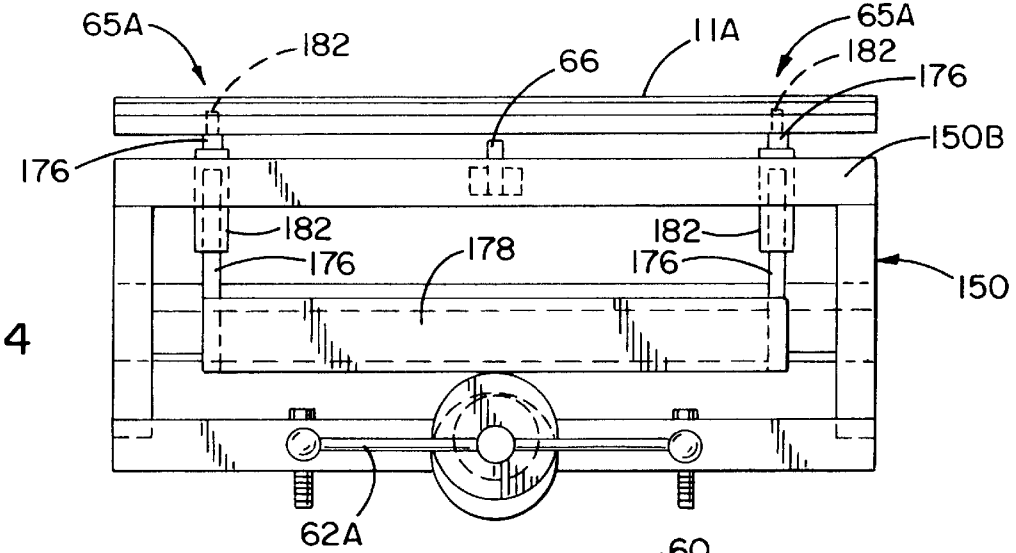
FIG. 14 is a front, elevation view of the printing station showing the cassette support and registering mechanism of FIG. 12.
Figure 15:
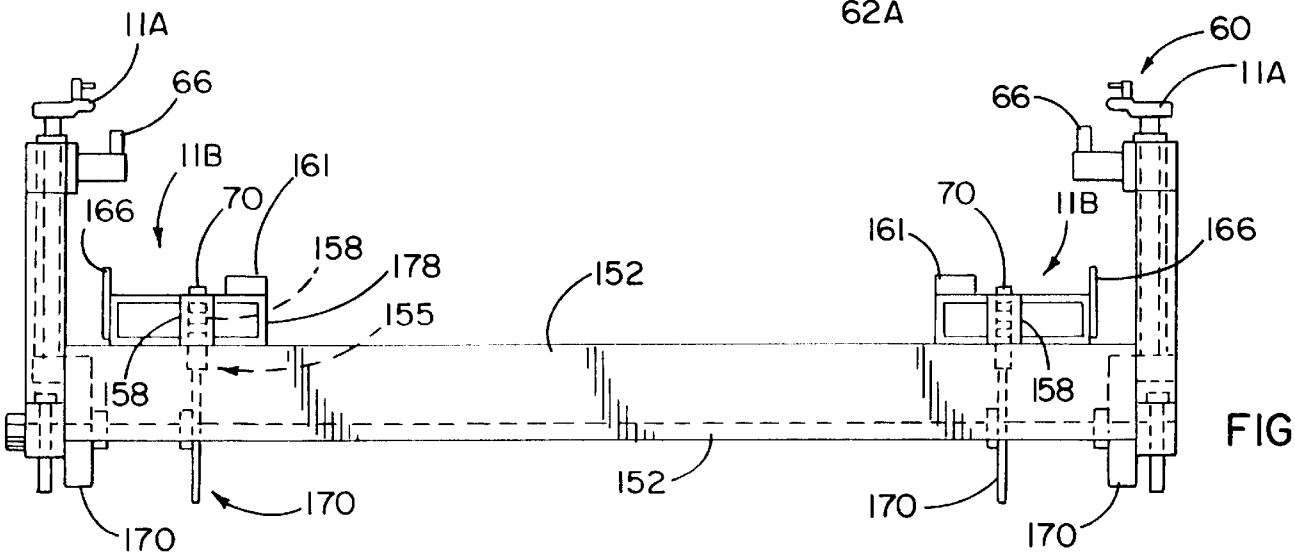
FIG. 15 is an end view of the printing station with a registering pin mechanism used in FIG. 14.

Once the jobs have been scheduled and the cassettes have been registered, they are loaded into a plurality of shelf positions in the cart 24 in the print sequence for each job with the first color, of the first job in position #1 (at the top). The operator controls the vertical movement of the cart 24 with an up and down push button. Depressing the up push button causes the motor to raise the cart and bring up the next cassette to the level of the print station. Depressing the down push button causes the motor to lower the cart and bring down the next cassette to the level of the print station. When the next cassette shelf approaches the level of the print head, it activates a series of two sensors which cause the motor to turn off when the tracks of the tower cart are aligned with the tracks leading to the print head of the press. The shelf positions in the cart have ½ inch rounded tracks that run the full length of the shelf and which line up with tracks on the press that lead to the print station. The wheels 25C on the cassettes have a concave radius that mates with the convex radius of the tracks 11B. This design restricts unwanted movement of the cassette front to back on the press and cart while providing a rolling motion along the track length. The selected cassette (with its printing screen) loaded in the cart is delivered to the print station as one unit by pulling the cassette sideways by hand from the cart shelf onto the tracks of the press. Once the cassette is fully extended over the print station it hits a stop that positions the cassette over the cassette guide pins. Once the cassette is positioned in place the operator flips the lever 62 lowering the print station and cassette assembly. The cassette, when lowered, receives the front and back locating pins 190 and stationary frame rails 151B thereby locking it into registration. This same lever action raises the set of platen carrier guide pins 70 that engage the platen carrier. This positions the platen carrier in an exact location relative to the cassette. As best seen in FIGS. 13, 14 and 15, the turning of the lever 62 rotates the attached horizontal cam shaft 64 in a box shaped weldment 151 (FIG. 12) that includes a paid of upright rectangular, front and back frames 151 having a lower tube 151A and upper tube 151B with vertical tubular legs 151C therebetween. Spanning the front and back frames 151 and welded thereto are a pair of spaced, horizontal, frame tubes 152. The ends of the cam shaft 654 are journaled for rotation in the front and rear lower tubes 151A of the weldment 151 to rotate the pallet locating pin lift 155 including the pallet locating pins 70 that are inserted into the locating bushings in the pallet to precisely locate the pallet at the printing station.

Figure 12:
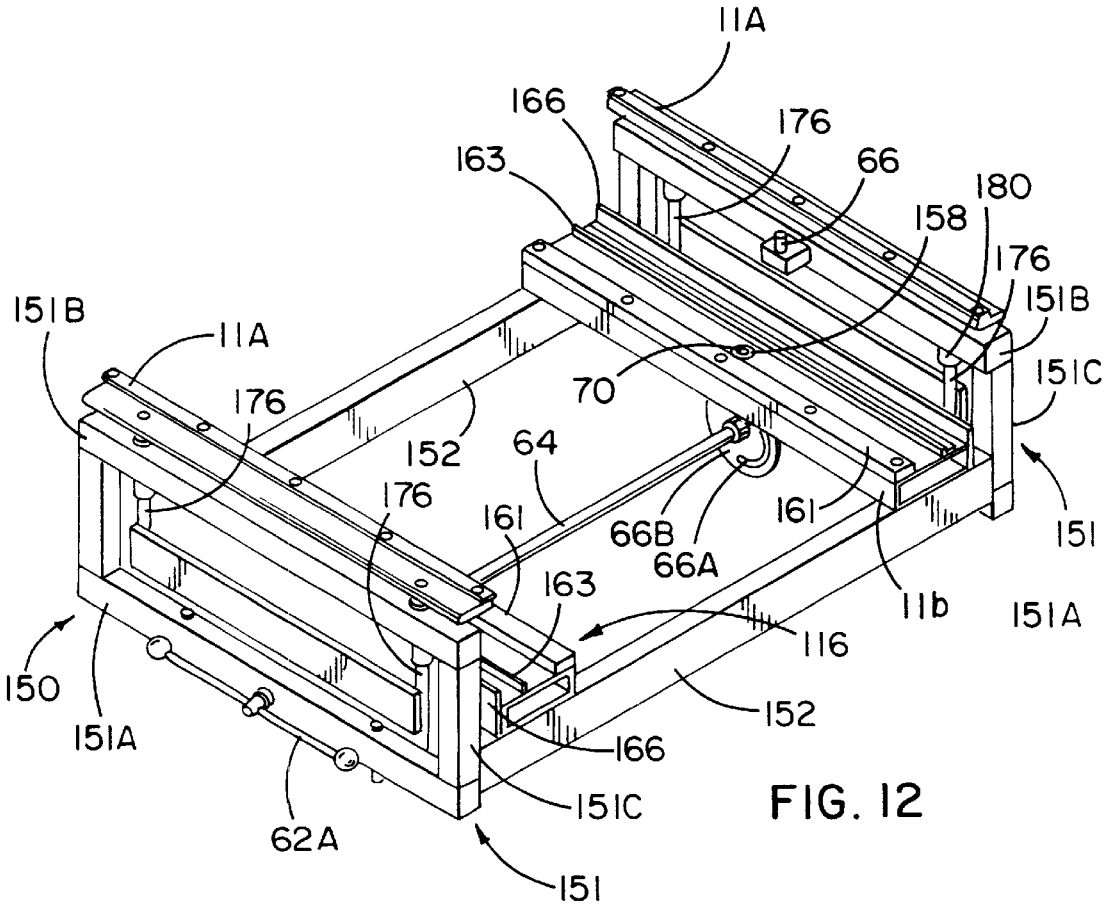
FIG. 12 is a perspective view of the printing station showing a cassette support and a lever-operated, cam mechanism used in registering cassettes at the printing station and pallet carts.

As best seen in FIGS. 12 and 15, the pallet locating pins 70 are slidable mounted in guides 158 of a pair of cassette support rails 11*b* at the printing station. Herein, the cassette support rails each comprise a slider pad 161 on which the wheels 25C slide, which is eccentrically mounted on an upper web of a paid of cross tubes 161 fixed at opposite ends to the frame tubes 152 of the frame weldment. The outer edges of the cassette wheels 25C are guided by a pair of upstanding flanges at wheel guide 163 (FIG. 12) on the cassette wheel rails 11B. The cams 66 have cam slots 66A (FIG. 12) which has a cam follower bearing so that turning the lever 62 through 180° in one direction lowers the pallet locating pins 70 and rotating 180° in the opposite direction raises the pins 70.

Fixed to the cam shaft 64 that turns the cams 66 to raise and lower the pallet locating pins are cams 170 that have similar cam follower bearings in cam slots similar to the cam slots 66*a*, but opposite in direction. That is, as the pallet pins are lowered, the box rails 175 for the print station are raised to allow a pallet to be removed and the screen on the cassette to be raised before a new substrate is positioned below the screen on the cassette. The print head box rails 175 carrying the cassette are mounted on the upper ends of four vertical, slide rods 176 which have their lower ends fixed to a paid of horizontal support plates 178 (FIG. 14) which are disposed over and connected to the macro cams 170 to lift or lower the print head rails 175 on turning of the cam shaft 64. The four slide rods 176 are mounted for vertical sliding in elongated, guide bushings 180 fixedly mounted at four corners of the pair of upper weldment tubes 151B of the box shaped weldments 151. As best seen in FIG. 14, screws 182 secure the box rails 175 to the upper ends of the four slide rods 176. Mounted on the stationary cross rails 151B are the locating pins 190 to locate the cassette. Thus, as the cam shaft turns the macro cams 170, the latter raise or lower the plates 178 carrying the four slide rods 176 to raise or lower the box rails 175.

Figure 18:
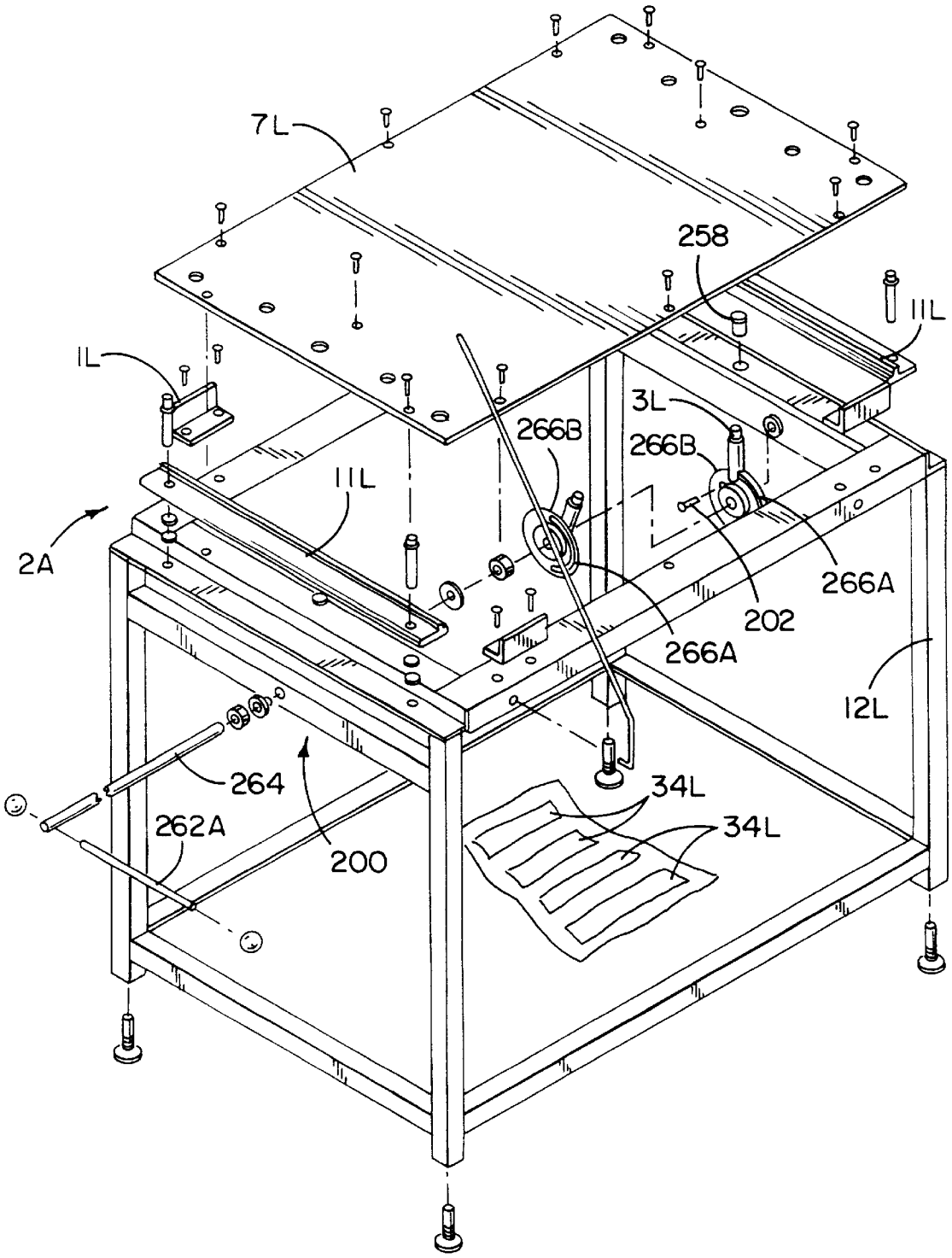
FIG. 18 is an exploded, diagrammatic view of a preregistration table showing the cassette registering mechanism on the preregistration unit.
Figure 18A:
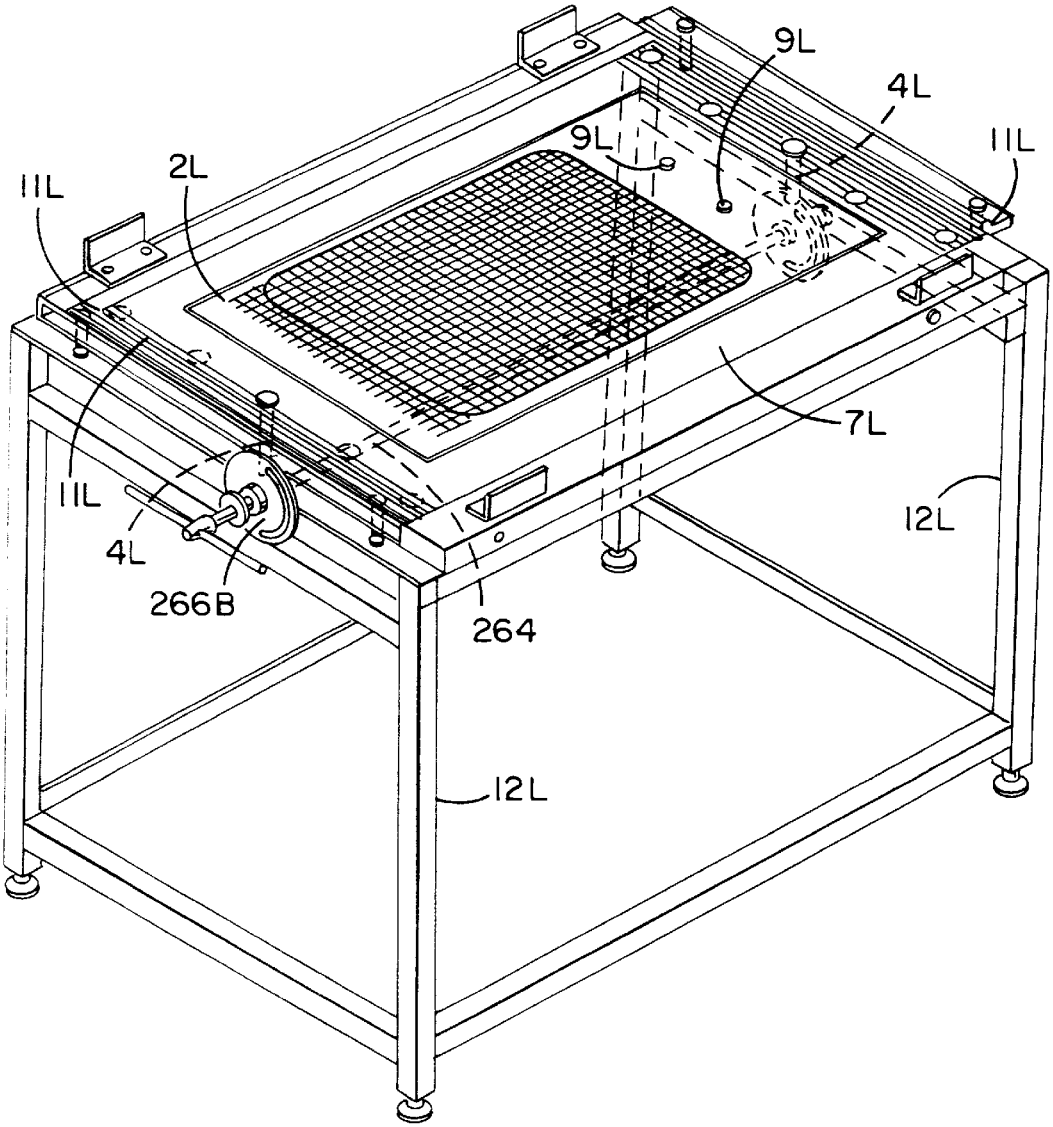
FIG. 18A is an isometric view of the preregistration unit.
Figure 18B:
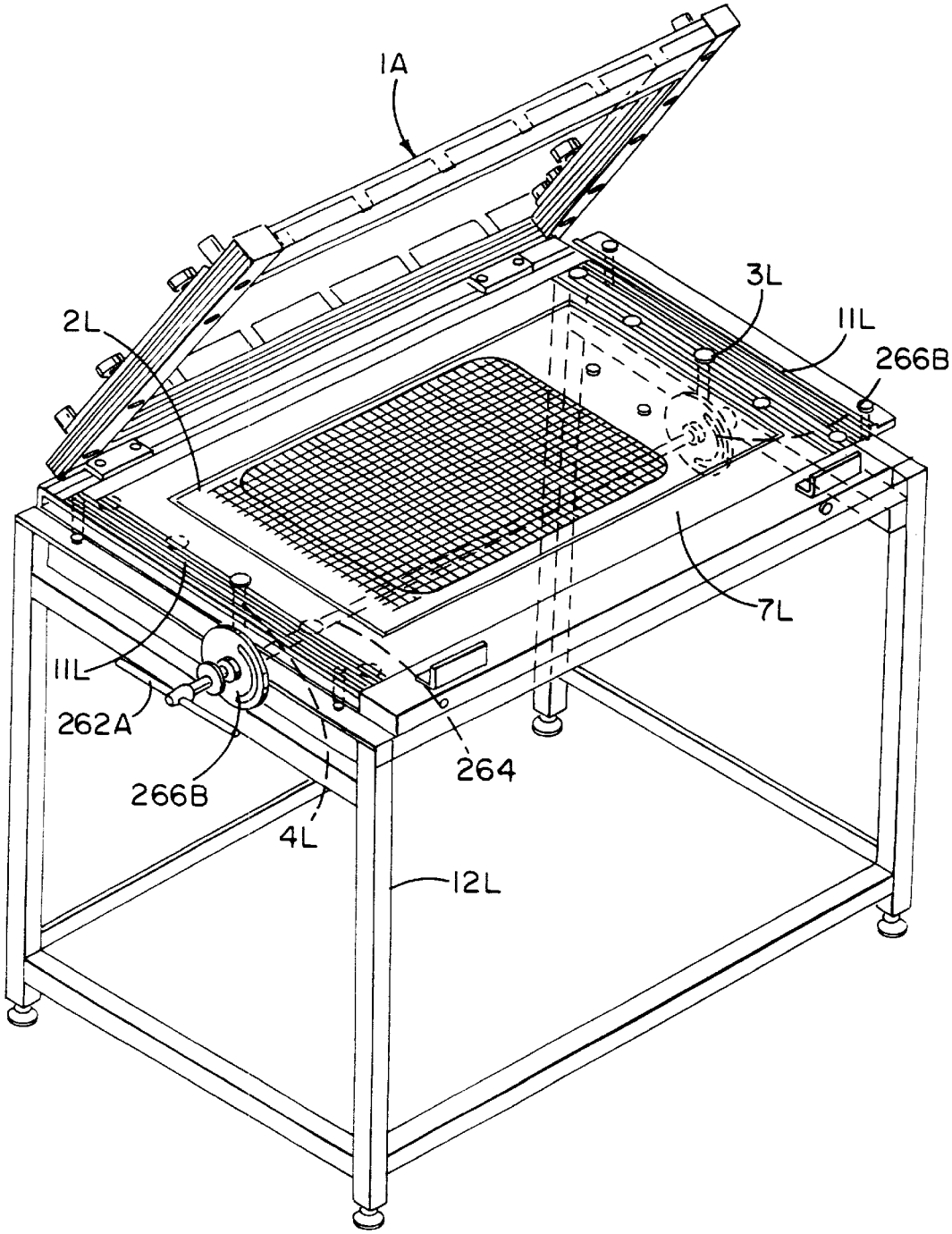
FIG. 18B is a view similar to FIG. 18A with a cassette pivoted up to allow pin holing.
Figure 19:
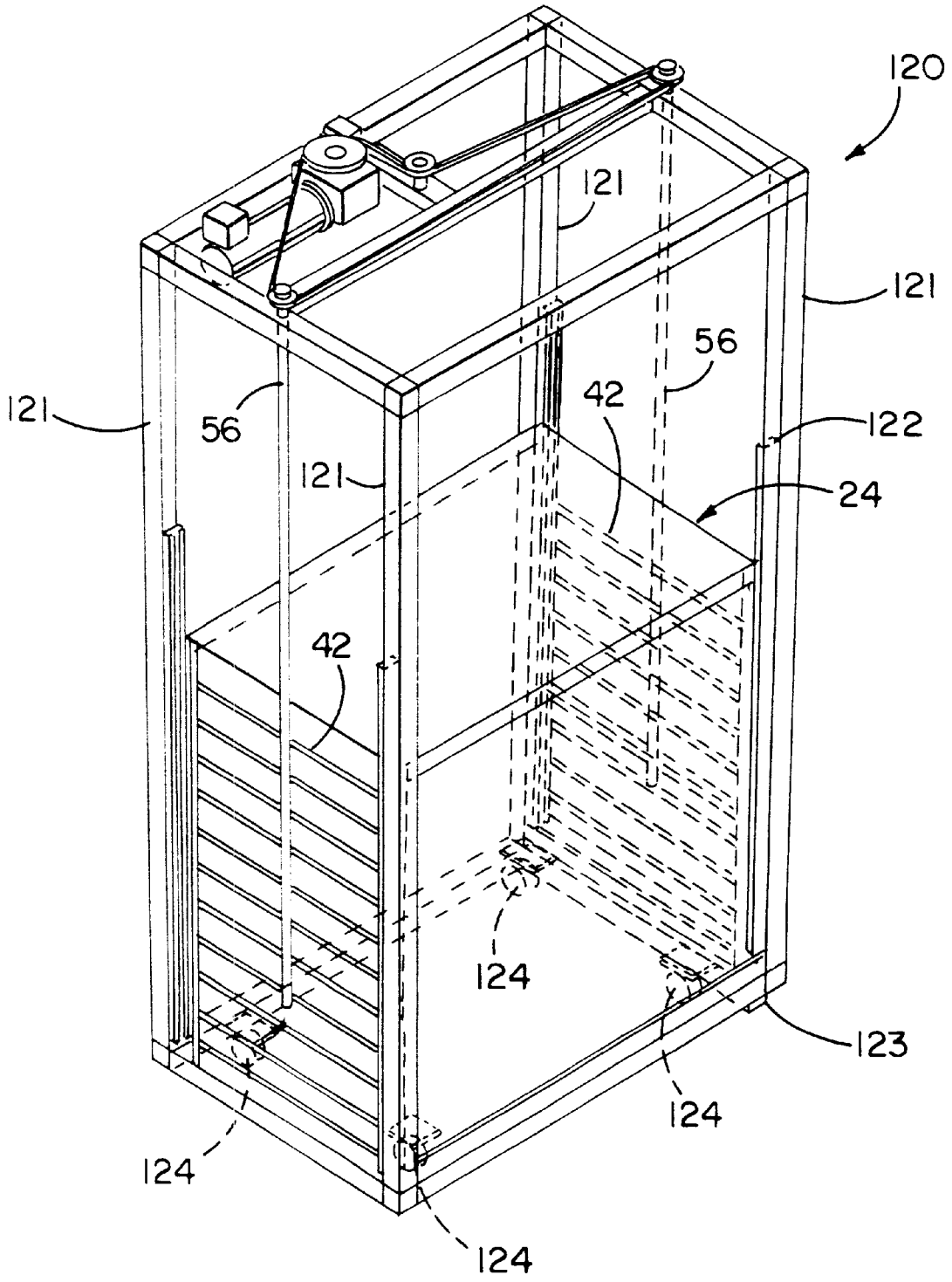
FIG. 19 is an isometric view of the tower and a cart being lifted by an elevator mechanism in the tower.

At the preregistration unit 2A, a similar cam alignment mechanism 200, as shown in FIG. 18, is used to align the cassette for preregistering the screen image. A prefix "2" is used to designate similar elements for the cam mechanism above described for the printing station. Thus, a handle 262 is used to turn a cam shaft 264 to turn a cam 266 having a curved slot 266A to raise and lower a dowel pin 3L in a bushing 258 in stationary, horizontal rail of the weldment. A pin 202 serves as a cam follower and is inserted into the slot 266A of the cam and is pinioned to the opposite sides of the slotted lower end of the dowel pin 270. The cassette wheels 25C will roll on the macro box rails 275 of the preregistration unit 2C in FIG. 18.

This relative position locking system ensures accurate registration between every platen with any cassette. Accordingly, the printer does not have to be involved in any on-press registration activity as exists with prior art, and can immediately focus on printing substrates.

Once the first color has been laid down on all the substrates loaded in the press, the cassette is slid back on the tracks into an open shelf position of the tower cart. The operator can then access the next image of the design, advancing the tower cart up or down one index position. The second cassette is then pulled out of the tower cart and into print position in the print station. In the event that a screen has not been registered or if it has fallen out of registration, the printer can easily use the joystick micro-registration system 30A after the cassette is loaded in the print station to quickly and accurately put the screen in total register with the previous imprint. Because the registration joysticks 30A are at the front of the cassette close to the operator, registration is a lot easier than in a rotary press where the micro-registration system is commonly located at the rear of the screen frame.

The invention requires less time to operate and requires fewer steps than a rotary press due to the motorized delivery of the platens 22 and the ease with which the screen loaded cassettes 1A are transferred to the print station 12 from the tower 3A. An operator of the subject invention will perform the following steps in imprinting an image: engage cassette locating pins 66, print stroke, flood stroke, disengage cassette locating pins 66, index platens 22 to position the next substrate. The fact that the platens are advanced by a motor driven conveyor mechanism 30 means that the operator does not need to put down the squeegee between printings and will have the squeegee in hand when the next platen comes up. For a rotary press, the same operation involves the following steps: lower screen frame over platen, print stroke, flood stroke, place squeegee in rear of screen frame, lift screen frame, rotate platens, locate screen frame to platen registration mechanism, pull down screen, pick up squeegee. The subject invention reduces operator fatigue during operation due to the reduction in the number of steps required in the printing process and the reduction in the amount of work involved in raising and lowering screen frames against a mechanical resistance such as a spring force. An operator of the printing system described herein does not have to lift and pull the screen frame up and down as with a rotary press. As a result, operators get less fatigued in completing an order to print the same number of impressions permitting them to maintain a higher production rate for longer periods of time.

In addition to the extra steps which a rotary press, in many rotary presses, the screen frame not being used at the print station is positioned at an angle and the squeegee is frequently stored at the back of the screen between printings. It is thus not uncommon on rotary presses for the squeegee to fall out of the screen or into the ink at the back of the screen when the screen is lifted off the platen to advance to the next substrate. When the operator returns to that squeegee, it contaminates the operators hands with ink and requires the operator to stop production to remove the ink from his hands and the squeegee to avoid contaminating substrates and thus producing costly scrap. The subject invention avoids such a problem because the screen frame loaded cassettes 1A are stored horizontally in the tower cart 24, thereby permitting storage of the squeegee to the side of the screen in a horizontal position. This placement also makes the squeegee easier to reach for the operator.

Figure 17:
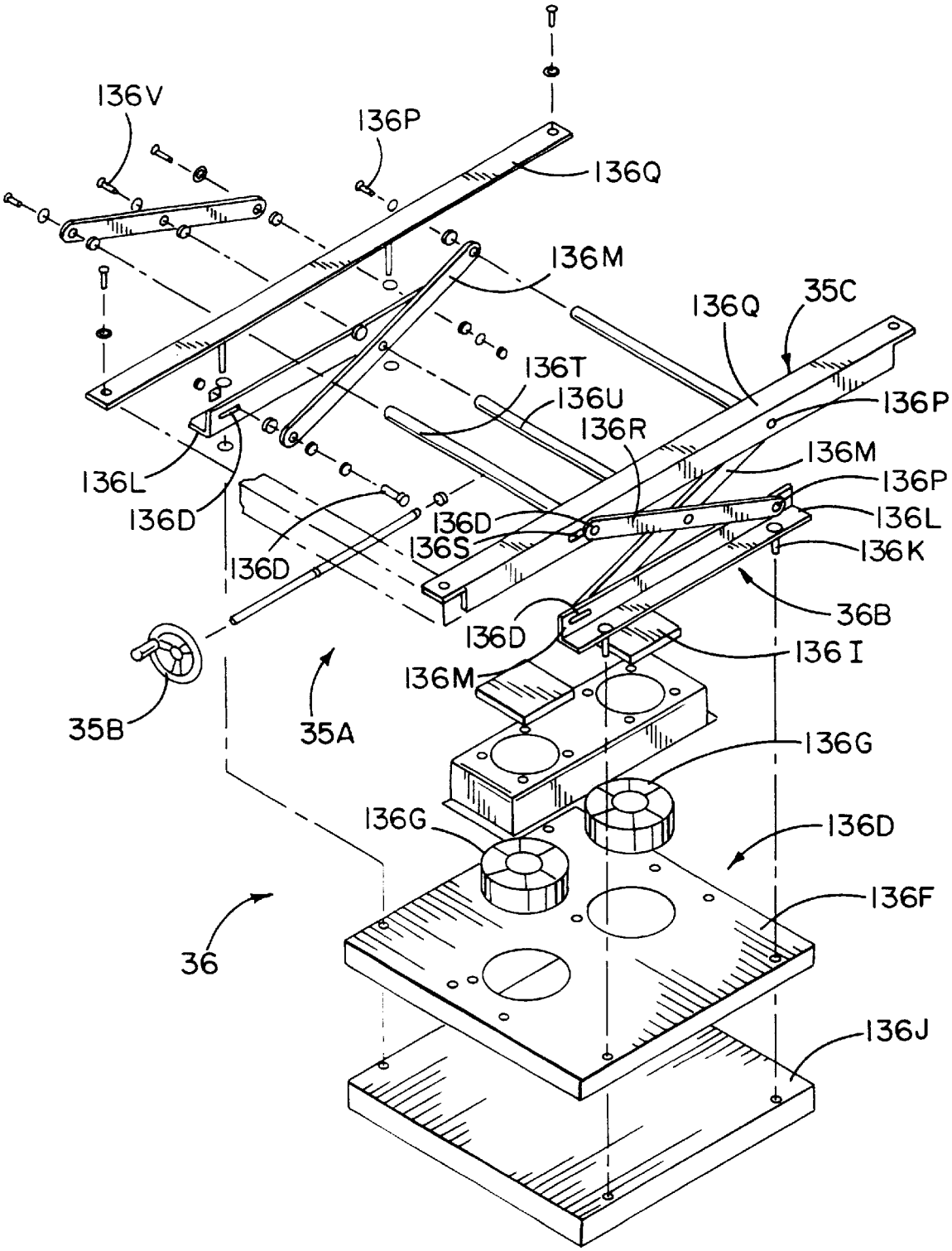
FIG. 17 is an exploded view of a curing apparatus located at a curing station.

The present invention also improves upon other types of screen printing systems because it includes flash curing/drying units 36 and a cooling unit 37 having fans on the press. The curing drying unit 36 is best seen in FIG. 17 and it includes an adjustable height support mechanism 36A operated by a rotatable handle 36B at the front of the printing press and extending inwardly to operate a scissors mechanism 36B to which is mounted a lamp housing assembly 136D. The lamp housing assembly comprises a housing supporting IR lamps and an overhead, horizontal plenum 136F in which are mounted a pair of fans 136G. The fans are covered by circular fan covers 136H and flat fan guard plates 136I. The bottom plate 136J and the plenum 136F of the lamp housing assembly are secured by fasteners 136K to the lower portion of the scissors mechanisms lamp support angles 136L.

The scissors mechanism includes a pair of downwardly inclined bars 136M mounted by pivot pins 136N in slots 136O in the lamp support angles 136L. Upper ends of the inner scissor bars 136M are secured by pivot pin 136P to the respective mounting angles 136Q which are horizontally entering and fixed to the press frame by supports, shown in phantom. A pair of outer scissor bars 136R have lower ends pivotally mounted by pivot pins to the lamp support angles 136L. The upper ends of the outer scissor bars have slidable pins 136O mounted to slide in elongated slots 136S in the mounting angles 136Q. The upper slidable pivot pins 136O are also threaded into opposite ends of a cross rod 136T. At the location of the crossing of the scissor bars in another cross rod 136U fastened by pivot pins 136V, a rear rod 136W is secured by the pivot pins 136P to the rear positions of the mounting angles 136Q. Thus, a well known scissors mechanism allows vertical movement of the lamps and fans to adjust the curing of the ink, as desired.

Other presses require a separate apparatus to dry and cool the printed garments. The integration of a curing unit 36 gives the operator the ability to flash cure every color all of the time thus eliminating smearing and the need for wash up between colors or between attempts to register a print on the press. Not only does the integration of the ability to flash cure garments result in a cleaner printing process, it also speeds up production. Flash speed is important because the time it takes to flash a print often dictates the maximum production rate that a press can attain. The flash cure unit in the invention is adjustable: it can be brought closer to the platen or the temperature can be raised for faster or more thorough gelling of the ink. The subject invention results in a reduction of the cure time when compared to a rotary press due to the fact that a substrate is actually at the print station less time then on the rotary press (i.e. fewer steps are required to complete an impression) and as a result it can be flashed at a much higher temperature for a shorter period of time. The integration of a cooling unit in the printing press negates the need to provide a specific cool down period or cooling apparatus and thereby further increases production and reduces costs.

The integrated drying unit 36 of the invention cures the ink on each substrate as the drive moves the platens 22 through the bottom of the press structure.

The drying unit is adjustable, in both position off the platen and set temperature and time exposure, for faster or more thorough gelling of the ink. This permits the invention to perform a quick flash cure between colors of a design to prevent smearing or perform a final drying cure after all colors have been printed. This can be accomplished by moving the heaters closer to the substrate after the last color is printed. One skilled in the art will recognize that there are other methods for controlling the height and temperature of the drying units for curing, including variable timed temperature control of the drying unit itself.

Following the heating unit, is a cooling unit 37 consisting of a commercially available cooling fan 38. The cooling fan blows room temperature air over each substrate as it is brought into position by the drive.

When the operator finishes printing the last color in a job, he pushes the last cassette 4A back into the tower cart 24 and presses the tower cart up/down push button so the first color of the next job is up next. When the operator prints the last completely printed substrate, the first dried substrate will be located on the immediately following platen and will have been cooled enough so that the operator can unload it. The invention provides two options for unloading completed substrates from the press. First, the substrates can be unloaded from the press after all substrates have been printed with all colors in the job and then loaded with new substrates for printing the next batch. Second, a separate person can unload the substrates from the end of the press and the printer can begin printing the next job when the first new substrate is positioned under the print station. It would be possible using the invention for one person to alternate between unloading two presses thus saving labor costs.

Several other features of the invention bear further description. While the pre-registration unit 2A provides advantages in registering a screen, the subject invention also gives the operator the option of registering a screen right on the press. To register a job on the press itself, the operator loads each screen frame for the job into a cassette, including the frame containing the keyline, and secures each frame using the lock downs. All of the cassettes for the job are then loaded into the tower cart 24. The operator pulls the cassette containing the keyline from the tower cart and positions it at the print station 12. The operator then prints two images of the keyline on two test substrates and cycles the substrates through the machine and flash cures each test substrate. When the first test substrate is again at the print station, the operator returns the cassette 4A containing the keyline back into the tower cart 24 and loads the first image cassette 1A of the job. The operator then checks to see if the keyline and image on the screen are in register, and if not, uses the joystick registration system 30A to bring the screen into accurate registration and tightens down the lock downs. The operator then prints a test image on the first keyline and checks the print. By printing two keyline substrates the operator can register to the first one and if further registration is required he can move to the next test substrate and use the first one to determine what adjustments are necessary. Once the screen is registered, the cassette is returned to the tower cart, and the test substrates are cycled through the machine and flash cured. The operator then positions the next cassette in the print station and repeats the registration procedure using the test substrates. Upon completion, all of the cassettes for the job in the tower cart will be registered and ready to print a production run.

The invention also permits the operator to inspect the quality of prints in two ways. The operator can move the screen out of the way by sliding the cassette just far enough back towards the tower to be able to see the print. Or after making an impression and indexing the platen carriers one position, the last imprint made is now directly visible to the operator at the load/unload station. If necessary, after inspection, the substrate can be repositioned under the print station by reversing the index direction of the platen carriers, and imprinted again for greater opacity of color or increase in ink volume deposit.

What is claimed is:

1. A method of screen printing using multiple printing screens with different images thereon comprising:

storing a plurality of screen printing cassettes having printing screens thereon in a magazine in a printing sequence;

placing a first screen printing cassette at a printing station;

loading a plurality of substrates each onto one of a series of pallets movable about an endless path into and from the printing station;

conveying the pallets by a motorized pallet conveyor into and from the printing station and about the endless path;

printing a first image on each of the substrates after transfer into the printing station;

removing the first cassette from the printing station after printing the image thereon onto each substrate and returning the first cassette to the magazine;

transferring a second screen printing cassette from the magazine to the printing station; and printing a second image on each substrate at the printing station from the second cassette after each substrate has been sequentially conveyed by the pallet conveyor into the printing station.

2. A method in accordance with claim 1 including operating a motorized magazine to shift cassettes thereof vertically from a stored position to a transfer position for transfer from the magazine to the printing station.

3. A method in accordance with claim 1 wherein transferring of the cassette from the magazine to the printing station comprises shifting the cassette laterally along a track from a transfer station to the printing station.

4. A method in accordance with claim 3 wherein the transferring of cassettes comprises rolling the cassettes along tracks between the magazine and the printing station.

5. A method in accordance with claim 1 wherein the printing of an image comprises manually moving a squeegee across the printing screen.

6. A method in accordance with claim 1 wherein the operator operates an actuator to register the cassette relative to the pallet prior to printing on the substrate.

7. A method in accordance with claim 6 wherein the registering comprises lowering the cassette onto registering pins and raising registering pins into the pallet at the printing station.

8. A method in accordance with claim 7 wherein the operator operates a lever actuator to lower the cassette and to raise the pallet registering pins.

9. A method in accordance with claim 1 including shifting the pallets orbitally about a horizontal axis while maintaining the pallets substantially horizontally as they travel about the endless path.

10. A method in accordance with claim 1 including at least one inspection station being provided adjacent the printing station; and shifting by the operator of a printed image and substrate from the printing station to the inspection station by selective operation of the pallet-motorized conveyor.

11. A method in accordance with claim 10 including providing an inspection station on each side of the printing station for permitting the operator to inspect an image on the substrate.

12. A method in accordance with claim 1 including operating a joystick micro-registration device to shift the screen and its image within the cassette while the cassette is at the printing station.

13. A method in accordance with claim 1 including:

loading of multiple jobs, each having its own set of sequentially-positioned cassettes, into the magazine;

transferring the cassettes of the first job sequentially from the magazine to the printing station, and printing the first job on a first series of substrates; and transferring the cassettes of the second job sequentially from the magazine to the printing station, and printing the second job on a second series of substrates.

14. A method in accordance with claim 1 including curing the images on the substrates at a different, vertical level along the endless path than the level of the printing station.

15. A method in accordance with claim 1 including heating the ink on the substrates at a location below the printing station to assist in curing the ink.

16. A method in accordance with claim 15 including cooling the substrate and ink after it has been heated and prior to another printing operation on the substrate.

17. A method in accordance with claim 1 including:

providing a wheeled magazine; and rolling one magazine from the printing station and rolling a second magazine with cassettes therein into an operative position for transfer of cassettes to the printing station.

18. A method in accordance with claim 1 including:

loading a plurality of cassettes for a first color printing job using a first, predetermined number of colors into the magazine in printing sequence;

loading a second plurality of cassettes for a color printing job using a different number of colors into the magazine in printing sequence; and printing each of the respective color jobs without tearing down and setting up a screen printing apparatus used for the respective color printing jobs.

19. A method in accordance with claim 1 including:

printing color-proof images on a substrate for a customer;

storing the cassettes in the magazine;

obtaining the customer's approval of the proofs; and subsequently printing the customer's order by shifting the cassettes from magazine without having to re-set up the job.

20. A method in accordance with claim 1 including:

an operator operating a switch to operate the motorized, pallet conveyor to sequentially shift each of the pallets through one step in the endless path and to shift one pallet into the printing station;

an operator manually moving a squeegee across the printing screen on the cassette sequentially for each of the substrates to print a first color on each of the substrates at the printing station;

sliding the cassette along a track manually by the operator after printing the first color onto a shelf in the magazine;

an operator operating a conveyor in the magazine to shift vertically a second cassette for printing a second color image into alignment with the track;

the operator transferring the second cassette by the operator sliding the cassette along the track to the printing station; and manual operation of an actuator by the operator to register the cassette relative to the pallet prior to printing the second colors by a manual squeegee operation using the second image and a second color on the second cassette.

21. A method in accordance with claim 1 including:

providing a vertical magazine with shelves for the cassettes and a motorized conveyor therein to shift the shelves and cassettes vertically; and the operator selectively operating the motorized conveyor to raise or lower a cassette to a transfer level for removal of a cassette from a shelf.

22. A screen printing apparatus for screen printing multiple colors onto a substrate comprising:

a frame for the apparatus;

a magazine holding a plurality of screen printing cassettes therein in sequential order;

a screen printing station on the screen printing frame for receiving the cassettes therein sequentially from the magazine for printing of colors in sequence on the substrate;

a series of pallets each carrying a substrate mounted for travel in the frame; and a motorized pallet conveyor for carrying the pallets in an endless path about a horizontal axis while keeping the pallets substantially horizontal as the pallets travel to and from the printing station.

23. A screen printing apparatus in accordance with claim 22 wherein a single screen printing station is provided on the frame; and a manual squeegee is provided for manually squeezing the ink onto the substrates.

24. A screen printing apparatus in accordance with claim 23 wherein a manually actuatable switch is operated by the operator to index a pallet into the printing station and to index another pallet from the printing station.

25. A screen printing apparatus in accordance with claim 23 wherein:

a tower is provided for holding the magazine;

the magazine is a cart having shelves therein for the cassettes; and a lifting mechanism lifts the cart with cassettes on the shelves.

26. A screen printing apparatus in accordance with claim 22 wherein:

a track is provided on the frame between the printing station and the magazine; and the cassettes travel along the track between the magazine and the printing station.

27. A screen printing apparatus in accordance with claim 22 wherein a manually actuatable switch is provided for operation by the operator to shift the cassettes in the magazine to a transfer position for removal from the magazine.

28. A screen printing apparatus in accordance with claim 22 wherein a cassette raising lowering device is provided and is operated by the operator to shift the cassette to and from the substrate.

29. A screen printing apparatus in accordance with claim 28 wherein a pallet-registering device is operated by the operator to register the pallet at the printing station.

30. A screen printing apparatus in accordance with claim 28 wherein a common actuator is provided for operation by the operator to simultaneously shift the cassette vertically to register the cassette, and to operate the pallet registering device to register the pallet.

31. A screen printing apparatus in accordance with claim 30 wherein the common actuator is a lever operated by the operator prior to a printing of an image and subsequent to the printing of an image.

32. A screen printing apparatus in accordance with claim 22 wherein an inspection station is located on the frame adjacent the printing station at the same level as the printing station; and the pallet conveyor indexes the pallet into and from the inspection station.

33. A screen printing apparatus in accordance with claim 32 wherein a second inspection station is located on an opposite side of the printing station.

34. A screen printing apparatus in accordance with claim 22 wherein a drying device for drying the ink on a substrate is located at a drying station along the endless path traversed by the substrates.

35. A screen printing apparatus in accordance with claim 22 wherein:

a pallet registering device registers the pallet at the printing station for precise positioning relative to the printing screen cassette; and a cassette-registering device registers the printing screen cassette with respect to the substrate at the printing station.

36. A screen printing apparatus in accordance with claim 35 wherein a manually-operated actuator mechanism simultaneously operates the respective pallet registering device and the cassette registering device.

37. A screen printing apparatus for multi-color screen printing on substrates comprising:

a frame;

at least one screen printing station on the frame for printing color images on substrates;

a motorized pallet conveyor for indexing pallets into and through the printing station;

a magazine for holding a plurality of cassettes each having printing screens for transfer to the printing station;

a lifting device for a plurality of movable carts having shelves therein to receive cassettes to define the magazine of cassettes; and a lifting device for lifting one of the movable carts to shift the cassettes to a transfer position for transfer to the printing station.

38. A screen printing apparatus in accordance with claim 37 wherein the lifting device comprises:

a stationary tower for receiving a movable cart therein; and a motor-driven lifting member for lifting the cart within the stationary tower and for indexing the cassettes into the transfer position.

* * * * *